US005753422A

United States Patent [19]

Shibahara et al.

[11] Patent Number: 5,753,422

[45] Date of Patent: May 19, 1998

[54] SILVER HALIDE COLOR PHOTOGRAPHIC MATERIAL

[75] Inventors: Yoshihiko Shibahara; Junichi Yamanouchi, both of Kanagawa, Japan

[73] Assignee: Fuji Photo Film Co., Ltd., Kanagawa, Japan

[21] Appl. No.: 637,897

[22] Filed: Apr. 26, 1996

[30] Foreign Application Priority Data

Apr. 27, 1995 [JP] Japan ..... 7-125597

[51] Int. Cl.[6] ..... G03C 7/46

[52] U.S. Cl. ..... 430/379; 430/567; 430/627; 430/631; 430/634; 430/531; 430/536

[58] Field of Search ..... 430/567, 569, 430/627, 631, 634, 523, 531, 536, 378, 379

[56] References Cited

U.S. PATENT DOCUMENTS

| | | | |
|---|---|---|---|
| 4,400,463 | 8/1983 | Naskasky | 430/567 |
| 4,865,946 | 9/1989 | Bowman | 430/536 |
| 5,147,771 | 9/1992 | Tsaur et al. | 430/567 |
| 5,385,819 | 1/1995 | Bowman et al. | 430/567 |
| 5,391,470 | 2/1995 | Yasuda et al. | 430/634 |

FOREIGN PATENT DOCUMENTS

| | | |
|---|---|---|
| 0121141 | 10/1984 | European Pat. Off. . |
| 61-156252 | 7/1986 | Japan . |
| 2-256043 | 10/1990 | Japan . |
| 8-297353 | 11/1996 | Japan . |
| 9-15803 | 1/1997 | Japan . |

*Primary Examiner*—Geraldine Letscher
*Attorney, Agent, or Firm*—Birch, Stewart, Kolasch & Birch, LLP

[57] ABSTRACT

A silver halide color photographic material is disclosed, which comprises a support having thereon a red-sensitive silver halide emulsion layer, a green-sensitive silver halide emulsion layer, and a blue-sensitive silver halide emulsion layer, wherein at least one emulsion layer contains a monodisperse tabular silver halide emulsion having an aspect ratio of 3 or more and less than 100 and relative standard deviation of grain sizes of 20% or less, and at least one layer contains at least one of the anionic water-soluble polymer represented by formula (1), the dispersion of alkali-soluble polymer represented by formula (2), or the dispersion of polymer represented by formula (3):

(1)

(2)

(3)

wherein the substituents are as defined herein the specification.

7 Claims, No Drawings

SILVER HALIDE COLOR PHOTOGRAPHIC MATERIAL

FIELD OF THE INVENTION

The present invention relates to a silver halide color photographic material and, in particular, to a silver halide color photographic material which is excellent in sharpness and graininess, and improved in push-processing suitability, the remaining color after development processing and desilvering failure.

BACKGROUND OF THE INVENTION

In recent years, demands for photographic capacities of color photographic materials have increasingly become severe, and demands for image qualities such as high sharpness and smooth graininess have become higher degree. Moreover, it has been required that such high quality images could be stably obtained irrespective of the development processing conditions.

Various studies have been done up to date with respect to the improvement of sharpness and graininess. One great progress in recent years is the use of a monodisperse tabular silver halide emulsion.

For example, color photographic materials which are improved in sharpness, sensitivity and graininess by using tabular silver halide emulsion grains are disclosed in U.S. Pat. Nos. 4,434,226 and 4,439,520. It is disclosed in U.S. Pat. No. 4,433,048 that the tabular grains whose AgI distribution within the grains increases from the center part toward the surface provide excellent sensitivity and size ratio.

Further, there are disclosed in JP-A-62-18556 (the term "JP-A" as used herein means an "unexamined published Japanese patent application") that the photographic materials using monodisperse tabular silver halide grains are superior to those using polydisperse tabular grains in image sharpness and graininess, in JP-A-63-151618 the preparation method of the above monodisperse tabular grains, and in JP-A-2-256043 that image sharpness and graininess can be improved by using the monodisperse tabular emulsion whose AgI distribution among silver halide emulsion grains is improved.

Further, techniques for enhancing monodispersibility using a polyalkylene oxide block copolymer are disclosed in U.S. Pat. Nos. 5,147,771, 5,147,772 and 5,147,773 and EP-A-513723.

Improvement of sharpness and graininess has been steadily progressed by these methods and high image quality capacities have been able to be obtained. However, when the above-described tabular silver halide grain emulsions are used, the following problems arise and it is not able to stably provide photographs having objective high quality images.

In the first place, when a tabular silver halide emulsion is used, such a problem arises that the remaining color is large. "Remaining color" as used herein means a phenomenon that the sensitizing dyes which are used for spectral sensitization are not removed completely from the photographic film during development processing and remain after processing, and they color, in particular, the white background, which is a large problem.

In the next place, when a tabular silver halide emulsion is used, a problem of desilvering failure is liable to occur. "Desilvering failure" as used herein means a phenomenon that the silver is not completely removed from the emulsion film and remains in the emulsion with the deterioration of the processing solution used for desilvering step during development processing, and the photograph is entirely colored yellow blackish, which is also problematic. These problems of remaining color and desilvering failure become large with the increase of the use ratio of a tabular silver halide grain emulsion and improving techniques thereof have been strongly desired.

In addition, when a monodisperse tabular silver halide emulsion is used, a problem arises such that a sensitization width during push-processing becomes small. In particular, in a color reversal photographic material, push-processing is often carried out by a method in which a processing time of the first development is prolonged, which is one of the important capacities of a color reversal photographic material. When a monodisperse tabular grain emulsion is used, a problematic phenomenon arises such that a sufficient sensitization width during push-processing cannot be secured.

SUMMARY OF THE INVENTION

Accordingly, the object of the present invention is to provide a silver halide color photographic material which is excellent in sharpness and graininess, and improved in push-processing suitability, the remaining color after development processing and desilvering failure.

The above object of the present invention has been achieved by the following:

(1) A silver halide color photographic material comprising a support having thereon a red-sensitive silver halide emulsion layer, a green-sensitive silver halide emulsion layer, and a blue-sensitive silver halide emulsion layer, wherein at least one emulsion layer contains a monodisperse tabular silver halide emulsion having an aspect ratio of 3 or more and less than 100 and relative standard deviation of grain sizes of 20% or less, and at least one layer contains at least one of the anionic water-soluble polymer represented by formula (1), the dispersion of alkali-soluble polymer represented by formula (2), or the dispersion of polymer represented by formula (3):

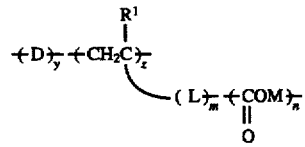

(1)

wherein $R^1$ represents a hydrogen atom, a substituted or unsubstituted lower alkyl group or a halogen atom; L represents a divalent to tetravalent linking group; M represents a hydrogen atom or a cation; m represents 0 or 1; n represents 1, 2 or 3; D represents a repeating unit of an ethylenically unsaturated monomer; y and z each represents weight percentage of each monomer component, y is from 0 to 95, z is from 5 to 100, and y+z=100;

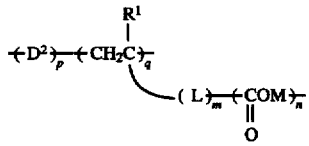

(2)

-continued

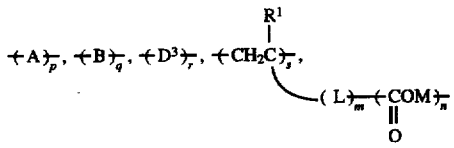

(3)

in formula (2), $D^2$ represents a repeating unit of at least one or more ethylenically unsaturated monomers; p and q each represents weight percentage of each monomer component, p is from 0 to 85, q is from 15 to 100, and p+q=100; in formula (3), A represents a repeating unit obtained by polymerizing a crosslinkable monomer having at least two copolymerizable ethylenically unsaturated groups; B represents a repeating unit obtained by copolymerizing the monomers represented by the following formula (4) the homopolymers of which have a clouding point in an aqueous solution; $D^3$ represents a repeating unit obtained by copolymerizing copolymerizable ethylenically unsaturated monomers other than the above;

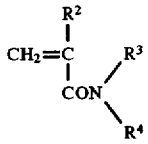

(4)

wherein $R^2$ represents a hydrogen atom or a lower alkyl group; $R^3$ and $R^4$, which may be the same or different, each represents a hydrogen atom, an alkyl group having from 1 to 8 carbon atoms or a substituted alkyl group, $R^3$ and $R^4$ do not represent a hydrogen atom at the same time, and $R^3$ and $R^4$ may be bonded to form a nitrogen-containing heterocyclic ring together with a nitrogen atom; p', q', r' and s' each represents weight percentage of each monomer component, p' is from 0.1 to 60, q' is from 10 to 70, r' is from 0 to 30 and s' is from 25 to 85, and p'+q'+r'+s'=100; and M, R, L, m and n in formulae (2) and (3) have the same meaning as in formula (1).

(2) A silver halide color photographic material comprising a support having thereon a red-sensitive silver halide emulsion layer, a green-sensitive silver halide emulsion layer, and a blue-sensitive silver halide emulsion layer, wherein all light-sensitive emulsion layers contain a monodisperse tabular silver halide emulsion having an aspect ratio of 3 or more and less than 100 and relative standard deviation of grain sizes of 20% or less, and at least one layer contains at least one of the anionic water-soluble polymer represented by formula (1), or the dispersion of polymer represented by formula (2) or (3).

(3) The silver halide color photographic material described in the above (1) or (2), wherein a swelling factor of the entire hydrophilic colloid layers on the light-sensitive emulsion layer-coated side of the support is from 160% to 200%, and a swelling factor of at least one layer of said hydrophilic colloid layers is from 200% to 400%.

(4) The silver halide color photographic material described in the above (1), (2) and (3), wherein a positive image is obtained by black-and-white developing the image-wise exposed photographic material and then color developing the photographic material using the remaining silver halide.

DETAILED DESCRIPTION OF THE INVENTION

The present invention is described in greater detail below.

The photographic material of the present invention contains in at least one layer at least one of the anionic water-soluble polymer represented by formula (1), or the dispersion of polymer represented by formula (2) or (3) which are described in detail below. The object of the present invention can be achieved by containing at least one of the anionic water-soluble polymer represented by formula (1), or the dispersion of polymer represented by formula (2) or (3), but it is more effective to contain at least one compound represented by formula (1) and at least one compound represented by formula (2) or (3) in combination. The compound represented by formula (2) or (3) is particularly effective for the improvement of push-processing suitability which is one object of the present invention.

It has been known for long to contain a polymer in a photographic material, for example, it has been disclosed in JP-A-61-156252 that a processing time can be shortened by containing a high water absorptive polymer having a solubility in water of 5 or more in a photographic material. However, it has not been known that desilvering failure and remaining color can be conspicuously improved by the polymer represented by formula (1), (2) or (3) according to the present invention. Also, it has not been known that the effect as in the present invention can be exhibited by the combined use with a monodisperse tabular grain emulsion.

The polymers according to the present invention are described in detail below.

One mode of the polymers according to the present invention is the anionic water-soluble polymer represented by formula (1).

More specifically, ethylenic monomers represented by D which can preferably be used are water-insoluble hydrophilic monomers and examples thereof include acrylamides and methacrylamides such as acrylamide, methacrylamide, N-methylacrylamide, N,N-dimethylacrylamide, N-ethylacrylamide, N-methyl-N-ethylacrylamide, N,N-diethylacrylamide, N-n-propylacrylamide, N-isopropylacrylamide, N-cyclopropylacrylamide, N-methyl-N-n-propylacrylamide, N-methyl-N-isopropylacrylamide, N-acryloylpiperidine, N-acryloylmorpholine, N-acryloylpyrrolidine, N-methacryloylpiperidine, N-n-propylmethacrylamide, N-isopropylmethacrylamide, and N-cyclopropylmethacrylamide, an N-vinyl cyclic compound such as N-vinylpyrrolidone and N-vinylcaprolactam, acrylic and methacrylic esters such as 2-hydroxyethyl acrylate, 2-hydroxyethyl methacrylate, 2-hydroxypropyl methacrylate, 2-methoxyethyl acrylate,

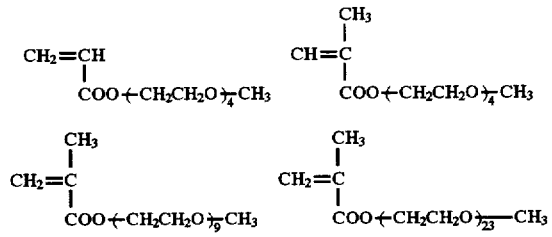

and 2-methanesulfonamidoethyl acrylate, and monomers having an anionic functional group other than a —COOH group such as 2-acrylamido-2-methylpropanesulfonic acid and salt thereof, styrenesulfonate, and styrenesulfinate.

Also, D may be a repeating unit of vinyl alcohol obtained by hydrolysis of vinyl esters (e.g., vinyl acetate).

Further, the ethylenically unsaturated monomers represented by D may be water-insoluble monomers provided that they do not impair the solubility of the polymers represented by formula (1) in water medium. Examples of such monomers include ethylene, propylene, 1-butene, isobutene, styrene, α-methylstyrene, vinyl ketone, monoethylenically unsaturated ester of aliphatic acid (e.g., vinyl acetate, allyl acetate), ethylenically unsaturated monocarboxylic acid ester or dicarboxylic acid ester (e.g., methyl methacrylate, ethyl methacrylate, n-butyl methacrylate, n-hexyl methacrylate, cyclohexyl methacrylate, benzyl methacrylate, n-butyl acrylate, n-hexyl acrylate, 2-ethylhexyl acrylate), a monoethylenically unsaturated compound (e.g., acrylonitrile), and dienes (e.g., butadiene, isoprene), but the ethylenically unsaturated monomers represented by D are not limited thereto.

$R^1$ represents a hydrogen atom, an unsubstituted alkyl group such as a methyl group, an ethyl group, an n-propyl group, or a substituted alkyl group such as a carboxymethyl group. A hydrogen atom, a methyl group or a carboxymethyl group is preferred of these.

L represents a divalent, trivalent or tetravalent linking group, and when L represents a divalent linking group, preferably represents —Q—, and when trivalent or tetravalent, preferably represents

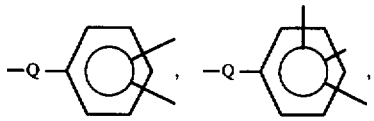

respectively. Herein, Q represents a divalent linking group and examples thereof include an alkylene group (e.g., methylene, ethylene, trimethylene), an arylene group (e.g., phenylene), —COO—X— (X represents an alkylene group or an arylene group having from 1 to about 6 carbon atoms, hereinafter the same) (e.g., $—COOCH_2CH_2—$), —COO—X—OCO— (e.g., $—COOCH_2CH_2OCO—$), —OCO—X— (e.g., $—OCOCH_2CH_2—$), —OCO—X—COO— (e.g., $—OCOCH_2CH_2CH_2CH_2COO—$), —CONH—X— (e.g., $—CONH—C_6H_4(p)—$), —CONH—X—NHCO— (e.g., $—CONHCH_2CH_2NHCO—$), and —CONH—X—OCO— (e.g., $—CONHCH_2CH_20CO—$).

m represents 0 or 1.

n represents 1, 2 or 3.

M represents a hydrogen atom or a cation.

Examples of cations include an alkali metal ion (e.g., sodium ion, potassium ion), and an ammonium ion (e.g., trimethylammonium ion, triethylammonium ion, tributylammonium ion), and particularly preferably an alkali metal ion.

Specific examples of ethylenically unsaturated monomers containing a —COOM group in formula (1) include acrylic acid, methacrylic acid, itaconic acid, p-vinylbenzoic acid, maleic anhydride,

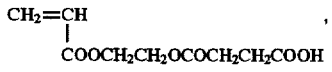

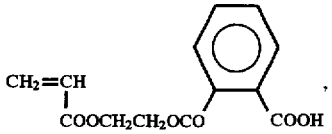

-continued

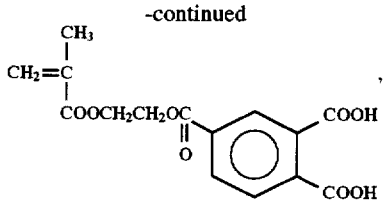

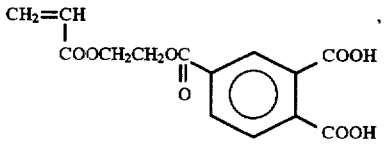

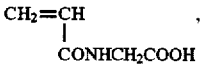

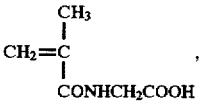

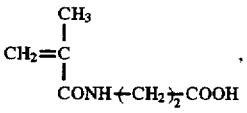

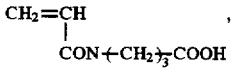

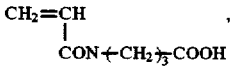

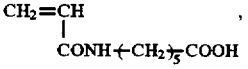

and

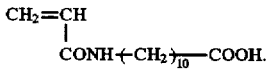

Of these, those soluble in distilled water at room temperature are particularly preferred.

Examples of such anionic monomers include acrylic acid, methacrylic acid, itaconic acid,

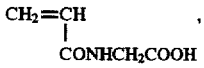

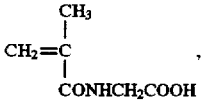

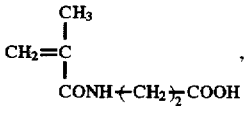

and

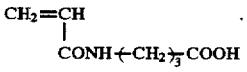

Monomers having these anionic groups may be used in the form of salt thereof such as an alkali metal salt (e.g., sodium salt, potassium salt) or an ammonium salt (e.g., a salt with ammonia, methylamine, dimethylamine).

Monomers represented by D and monomers having a —COOM group may be used respectively in combination of two or more.

y and z each represents weight percentage of each monomer component, y is from 0 to 95, preferably from 0 to 80, z is from 5 to 100, preferably from 20 to 100. y+z=100.

Water medium-soluble polymers of the present invention are particularly preferably represented by formula (5):

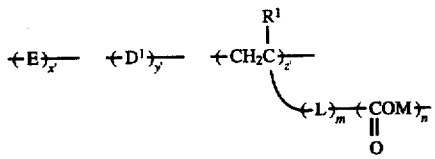

(5)

wherein E represents a repeating unit obtained by copolymerizing at least one compound selected from N,N-dimethylacrylamide, N-acryloylmorpholine, and N-acryloylpiperidine; $D^1$ represents a repeating unit obtained by copolymerizing an ethylenically unsaturated monomer removed N,N-dimethylacrylamide, N-acryloylmorpholine, and N-acryloylpiperidine from the above described D; $R^1$, L, M, m and n each has the same meaning as above; x', y' and z' each represents weight percentage of each monomer component, x' is from 1 to 99, y' is from 0 to 50, z' is from 1 to 99, and x'+y'+z'=100.

More specifically, $D^1$ represents a compound removed N,N-dimethylacrylamide, N-acryloylmorpholine, and N-acryloylpiperidine from the above described D, and specific examples thereof and examples of preferred compounds are the same as those described in D above.

$R^1$, L, M, m and n each has the same meaning as above.

x', y' and z' each represents weight percentage of each monomer component, x, is from 1 to 99, preferably from 5 to 95, y' is from 0 to 50, preferably from 0 to 30, z' is from 1 to 99, preferably from 5 to 95, and x'+y'+z'=100.

Polymerization of the polymers represented by formula (1) of the present invention can be carried out according to a generally well known radical polymerization method (details are disclosed, e.g., in Takayuki Ohtsu, Masayoshi Kinoshita, *Experimental Methods of Syntheses of Polymers*, Kagaku Dojin, 1972, pp. 124 to 154), in particular, a solution polymerization method is preferably used.

When a solution polymerization method is used, a polymerization reaction may be carried out after each monomer is dissolved in an appropriate solvent (e.g., water, or a mixed solvent of water and an organic solvent miscible with water (e.g., methanol, ethanol, acetone, N,N-dimethylformamide), or a polymerization reaction may be carried out with dripping each monomer to the solution. At that time, an appropriate auxiliary solvent (the same solvent as the above) may be used in the solution.

The above-described solution polymerization is carried out using an ordinary radical initiator (e.g., an azo-based initiator such as 2,2'-azobis(2-amidinopropane) dihydrochloride, a peroxide initiator such as potassium persulfate), in general, at 30° C. to about 100° C., preferably from 60° C. to about 95° C.

The polymers represented by formula (1) of the present invention and synthesis examples thereof are shown below, but the present invention is not limited thereto.

The copolymerization ratio described in the polymer examples indicate percentage of copolymerization and the ratio of M is in mol ratio.

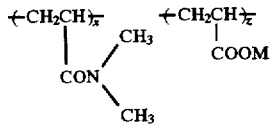

Q-1~Q-7

| x/z | M | |
|---|---|---|
| 5/95 | H/Na = 25/75 | Q-1 |
| 10/90 | " | Q-2 |
| 20/80 | " | Q-3 |
| 40/60 | " | Q-4 |
| 50/50 | " | Q-5 |
| 70/30 | " | Q-6 |
| 90/10 | " | Q-7 |

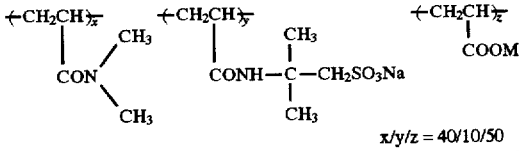

Q-8 x/y/z = 40/10/50
M = H/Na = 25/75

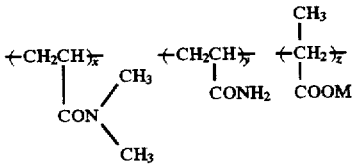

Q-9 x/y/z = 45/10/45
M = H/K = 10/90

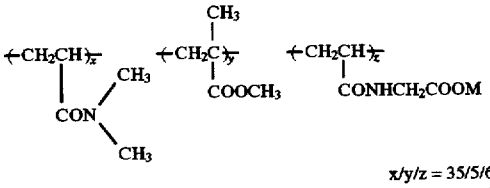

Q-10 x/y/z = 35/5/60
M = H/Na = 5/95

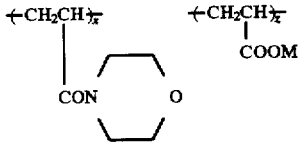

Q-11, 12

| x/z | M | |
|---|---|---|
| 20/80 | H/Na = 25/75 | Q-11 |
| 40/60 | " | Q-12 |

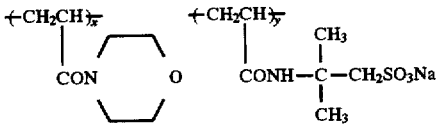

Q-13 x/y/z = 40/10/50
M = H/Na = 25/75

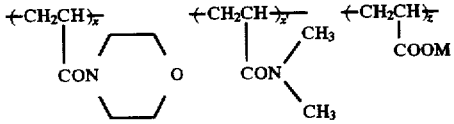

Q-14 x/x'/z = 20/20/60
M = H/K = 5/95

-continued

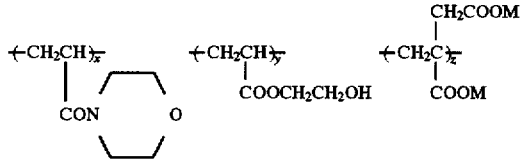

Q-15 x/y/z = 45/5/50
M = H/Na = 50/50

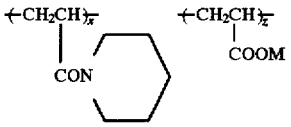

Q-16, 17

| x/z | M | |
|---|---|---|
| 20/80 | H/Na = 25/75 | Q-16 |
| 40/60 | " | Q-17 |

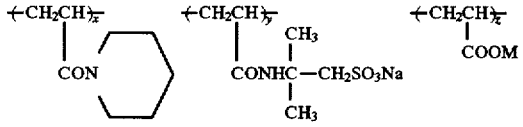

Q-18 x/y/z = 40/10/50
M = H/Na = 25/75

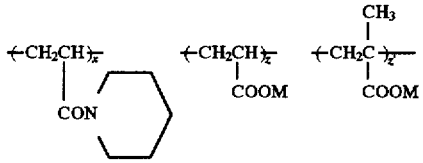

Q-19 x/z/z' = 40/30/30
M = H/Na = 20/80

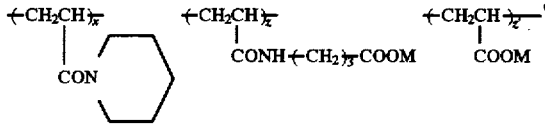

Q-20 x/z/z' = 50/20/30
M = H/K = 5/95

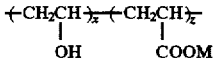

Q-21, 22

| x/z | M | |
|---|---|---|
| 60/40 | H/Na = 25/75 | Q-21 |
| 30/70 | " | Q-21 |

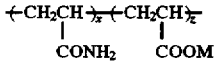

X/z = 20/80
M = H/Na = 20/80 Q-23

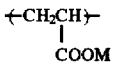

M = H/Na = 20/80 Q-24

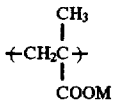

M = H/Na = 40/60 Q-25

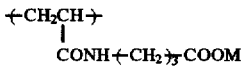

M = H/Na = 25/75 Q-26

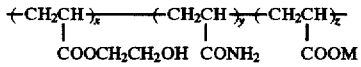

Q-27 x/y/z = 30/30/40, M = H/K = 20/80

-continued

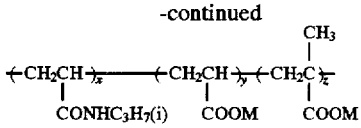

Q-28 x/y/z = 50/25/25, M = H/Na = 20/80

Another mode of the polymers according to the present invention is the dispersion of alkali-soluble polymer represented by formula (2), or the dispersion of polymer represented by formula (3).

More specifically, water-insoluble ethylenically unsaturated monomers are preferably used as $D^2$ in formula (2), and examples of such monomers include ethylene, propylene, 1-butene, isobutene, styrene, α-methylstyrene, vinyl ketone, monoethylenically unsaturated ester of aliphatic acid (e.g., vinyl acetate, allyl acetate), ethylenically unsaturated monocarboxylic acid ester or dicarboxylic acid ester (e.g., methyl methacrylate, ethyl methacrylate, n-butyl methacrylate, n-hexyl methacrylate, cyclohexyl methacrylate, benzyl methacrylate, n-butyl acrylate, n-hexyl acrylate, 2-ethylhexyl acrylate), a monoethylenically unsaturated compound (e.g., acrylonitrile), and dienes (e.g., butadiene, isoprene), but it should not be construed as being limited thereto.

Further, $D^2$ may be copolymerized with a water-soluble ethylenically unsaturated monomer, and examples of such monomers include acrylamides and methacrylamides such as acrylamide, methacrylamide, N-methylacrylamide, N,N-dimethylacrylamide, N-ethylacrylamide, N-methyl-N-ethylacrylamide, N,N-diethylacrylamide, N-n-propylacrylamide, N-isopropylacrylamide, N-cyclopropylacrylamide, N-methyl-N-n-propylacrylamide, N-methyl-N-isopropylacrylamide, N-acryloylpiperidine, N-acryloylmorpholine, N-acryloylpyrrolidine, N-methacryloylpiperidine, N-n-propylmethacrylamide, N-isopropylmethacrylamide, and N-cyclopropylmethacrylamide, an N-vinyl cyclic compound such as N-vinylpyrrolidone and N-vinylcaprolactam, acrylic and methacrylic esters such as 2-hydroxyethyl acrylate, 2-hydroxyethyl methacrylate, 2-hydroxypropyl methacrylate, 2-methoxyethyl acrylate, and 2-methanesulfonamidoethyl acrylate, and monomers having an anionic functional group other than a —COOH group such as 2-acrylamido-2-methylpropanesulfonic acid and salt thereof, styrenesulfonate, and styrenesulfinate.

The ethylenically unsaturated monomers represented by $D^2$ may comprise various monomers in arbitrary ratios as long as the polymers represented by formula (2) can exist as a water-insoluble dispersion, and also $D^2$ can be varied according to the degree of the polarity of a —COOM-containing monomer.

Accordingly, as p and q each represents weight percentage of each monomer component, and p is from 0 to 85, q is from 15 to 100, more specifically, when the —COOM—containing monomer is a water-soluble monomer in a non-neutralized state, p is from 30 to 85 and q is from 15 to 70, and when the —COOM-containing monomer is a water-insoluble monomer in a non-neutralized state, p is from 0 to 70 and q is from 30 to 100. p+q=100.

The polymers represented by formula (3) are described in detail below.

Examples of copolymerizable ethylenically unsaturated monomers providing a repeating unit represented by A include methylenebisacrylamide, ethylenebisacrylamide, divinylbenzene, ethylene glycol dimethacrylate, diethylene glycol dimethacrylate, triethylene glycol dimethacrylate, ethylene glycol diacrylate, diethylene glycol diacrylate, 1,6-hexanediol diacrylate, neopentyl glycol dimethacrylate, and tetramethylene dimethacrylate, and methylenebisacrylamide, divinylbenzene and ethylene glycol dimethacrylate are particularly preferred of them.

B represents a repeating unit derived from the monomers represented by formula (4) the homopolymers of which have a clouding point in water.

Here, a clouding point means a phenomenon such that when an aqueous solution of a homopolymer dissolved in distilled water in concentration of 1 wt % is heated, the transparent solution precipitates and becomes white turbid at a certain temperature or more (0° C. to 100° C.).

The monomers represented by formula (4) is described in greater detail. $R^2$ represents a hydrogen atom or a lower alkyl group having from 1 to 4 carbon atoms (preferably methyl).

$R^3$ and $R^4$, which may be the same or different, each represents a hydrogen atom, an alkyl group having from 1 to 8 carbon atoms (preferably from 1 to 4), a cycloalkyl group, or a substituted alkyl group such as an alkoxyalkyl group (e.g., a methoxyalkyl group or an ethoxyalkyl group), and preferred alkyl groups are methyl, ethyl, n-propyl, cyclopropyl, isopropyl, n-butyl and sec-butyl.

$R^3$ and $R^4$ may be bonded to form a nitrogen-containing heterocyclic ring together with a nitrogen atom, and preferred heterocyclic rings include a pyrrolidine ring and a piperidine ring. $R^3$ and $R^4$ do not represent a hydrogen atom at the same time.

Preferred examples of the monomers represented by formula (4) include N-ethylacrylamide, N-methyl-N-ethylacrylamide, N,N-diethylacrylamide, N-n-propylacrylamide, N-isopropylacrylamide, N-cyclopropylacrylamide, N-methyl-N-n-propylacrylamide, N-methyl-N-isopropylacrylamide, N-acryloyl-pyrrolidine, N-acryloylpiperidine, N-n-propylmethacrylamide, N-isopropylmethacrylamide and N-cyclopropylmethacrylamide.

With respect to clouding points of homopolymers of these monomers, *Kobunshi Gakkai Yoko-Shu* (*A Collection of Preliminary Treatises of Polymer Institution*), Vol. 38, p. 104 can be referred to.

Preferred ethylenically unsaturated monomers represented by $D^3$ are those soluble in distilled water at room temperature. Examples of such monomers include acrylamides such as acrylamide, methacrylamide, N-methylacrylamide, N-acryloylmorpholine, N-methacryloylmorpholine, and N,N-dimethylacrylamide, an N-vinyl cyclic compound such as N-vinylpyrrolidone and N-vinylcaprolactam, acrylic and methacrylic esters such as 2-hydroxyethyl acrylate, 2-hydroxyethyl methacrylate, 2-hydroxypropyl methacrylate, 2-methoxyethyl acrylate, and 2-methanesulfonamidoethyl acrylate, and monomers having an anionic functional group other than a —COOH group such as 2-acrylamido-2-methyl-propanesulfonic acid and salt thereof, styrenesulfonate, and styrenesulfinate. Of these, it is particularly preferred to use one or more monomers having an anionic functional group other than a —COOH group.

Further, monomers other than the above monomers may be used as the ethylenically unsaturated monomer represented by $D^3$, and examples of such monomers include ethylene, propylene, 1-butene, isobutene, styrene, (-methylstyrene, vinyl ketone, monoethylenically unsaturated ester of aliphatic acid (e.g., vinyl acetate, allyl acetate), ethylenically unsaturated monocarboxylic acid ester or dicarboxylic acid ester (e.g., methyl methacrylate, ethyl methacrylate, n-butyl methacrylate, n-hexyl methacrylate, cyclohexyl methacrylate, benzyl methacrylate, n-butyl acrylate, n-hexyl acrylate, 2-ethylhexyl acrylate), a monoethylenically unsaturated compound (e.g., acrylonitrile), and dienes (e.g., butadiene, isoprene).

$R^1$, L, M, m and n have the same meaning as above. p', q', r' and s' each represents weight percentage of each monomer component. p' is from 0.1 to 60, preferably from 0.5 to 40, particularly preferably from 1 to 20, q' is from 10 to 70, preferably from 20 to 60, particularly preferably from 25 to 55, r' is from 0 to 30, preferably from 0.5 to 25, particularly preferably from 1 to 20, and s' is from 25 to 85, preferably from 30 to 75, particularly preferably from 35 to 70.

It is preferred that the polymers represented by formula (3) of the present invention have a constitution such that 80 wt % or more of the entire component comprise repeating units derived from water-soluble monomers.

Particularly preferred polymer dispersion of the present invention is the dispersion of polymer represented by formula (3), and more preferably N,N-dimethylacrylamide, N-acryloylpiperidine or N-acryloylmorpholine is copolymerized as $D^3$ or B.

The preparation method of the polymer dispersion according to the present invention is described below.

The polymers represented by formula (2) of the present invention can be prepared according to a generally well known radical polymerization method, in particular, an emulsion polymerization method (details are disclosed, e.g., in Takayuki Ohtsu, Masayoshi Kinoshita, *Experimental Methods of Syntheses of Polymers*, Kagaku Dojin, 1972, pp. 124 to 154).

An emulsion polymerization method is carried out using an emulsifier, if necessary, and monomers are emulsified in water or a mixed solvent of water and an organic solvent miscible with water (e.g., methanol, ethanol, acetone) using a radical initiator, in general, at 30° C. to about 100° C., preferably from 40° C. to about 90° C. The amount of an organic solvent miscible with water is from 0 to 300%, preferably from 0 to 15%, in volume ratio based on water.

A polymerization reaction is generally carried out using from 0.05 to 5 wt % of a radical polymerization initiator and, according to necessity, from 0.1 to 10 wt % of an emulsifier based on the monomers to be polymerized. As a polymerization initiator, an azobis compound, peroxide, hydroperoxide, a redox catalyst, e.g., potassium persulfate, ammonium persulfate, tert-butyl peroctoate, benzoyl peroxide, isopropyl percarbonate, 2,4-dichlorobenzoyl peroxide, methyl ethyl ketone peroxide, cumene hydroperoxide, dicumyl peroxide, azobisisobutyronitrile, and 2,2'-azobis(2-amidinopropane)hydrochloride can be cited.

A water-soluble polymer can be used as an emulsifier, in addition to anionic, amphoteric and nonionic surfactants, e.g., sodium laurate, sodium dodecylsulfate, sodium 1-octoxycarbonylmethyl-1-octoxycarbonylmethanesulfonate, sodium laurylnaphthalenesulfonate, sodium laurylbenzenesulfonate, sodium laurylphosphate, polyoxyethylenenonylphenyl ether, polyoxyethylenesorbitanlauryl ester, polyvinyl alcohol, and the emulsifiers and the water-soluble polymers disclosed in JP-B-53-6190 (The term "JP-B" as used herein means an "examined Japanese patent publication").

In emulsion polymerization, the kind of polymerization initiator, concentration, polymerization temperature, and reaction time can, of course, be widely and easily varied according to the purpose.

The compound represented by formula (3) of the present invention can be synthesized according to a generally well known emulsion polymerization method using, in general, a copolymerizable monomer having at least two ethylenically unsaturated groups represented by A described above, the monomer represented by formula (4), an ethylenically unsaturated monomer represented by $D^3$, and an ethylenically unsaturated monomer having at least one anionic functional group.

When the anionic functional group in the polymer is used in the form of a salt, polymerization may be carried out using the monomer in the form of a salt, or a basic compound may be added to the polymer after polymerization, but it is particularly preferred to add a basic compound after polymerization. Of the finally obtained dispersion of polymer represented by formula (3), the proportion of M taking the form of a salt such as an alkali metal or an ammonium ion is preferably from 70 to 100 mol % of the entire —COOM.

As the anionic crosslinked polymer to be prepared has ionic charge and comparatively stably dispersed in water, a surfactant is often not necessary to be added to water, but it is feasible to stabilize a state of dispersion in water of the anionic crosslinked polymer by adding a surfactant as assistant.

Surfactants which can be used include, for example, an anionic surfactant (e.g., sodium dodecylsulfate, Triton 770 (commercially available from Rohm & Haas)) and a nonionic surfactant (e.g., EMALEX NP-20 (commercially available from Nihon Emulsion Co.)).

Further, water-soluble polymers such as polyvinyl alcohol and gelatin can also be used.

A polymerization reaction is carried out, in general, in the presence of a radical polymerization initiator (e.g., the combined use of potassium persulfate and sodium hydrogensulfite, V-50 commercially available from Wako Pure Chemical Industries Ltd.) at a temperature of generally from 30° C. to about 100° C.

Polymerization may be carried out by adding the entire amount of monomer to a medium (water, or a mixed solvent of water and an organic solvent miscible with water, e.g., methanol, acetone), or may be carried out by dropwise adding the monomer mixture to a medium, but dropwise addition is particularly preferred.

With respect to the above-described surfactants, polymerization initiators and polymerization methods, Takayuki Ohtsu, Masayoshi Kinoshita, Experimental Methods of Syntheses of Polymers (Kagaku Dojin) can be referred to.

Preferred examples of the polypolymer dispersions for use in the present invention are shown below, but the present invention is not limited thereto. The ratio of each monomer component of the polymer dispersion is indicated in wt % and M represents mol %.

P-1

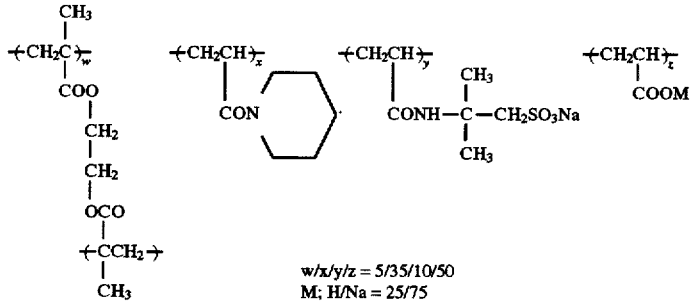

w/x/y/z = 5/35/10/50
M; H/Na = 25/75

P-2

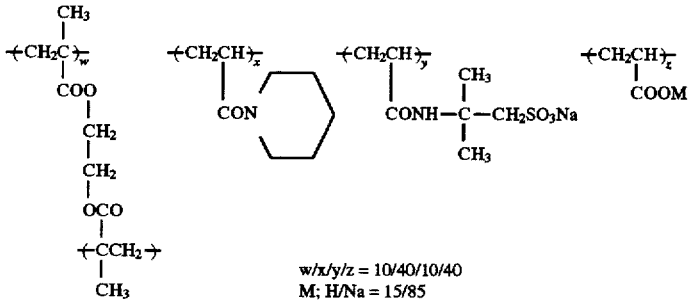

w/x/y/z = 10/40/10/40
M; H/Na = 15/85

P-3

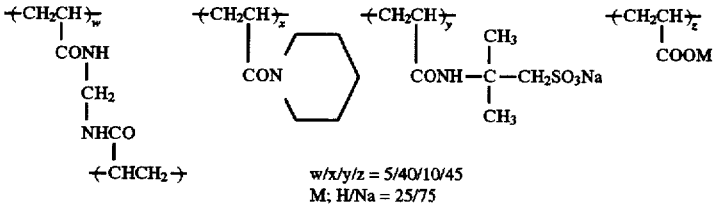

w/x/y/z = 5/40/10/45
M; H/Na = 25/75

-continued
P-4
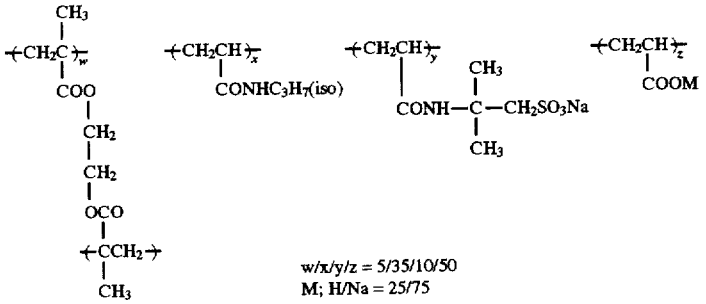
w/x/y/z = 5/35/10/50
M; H/Na = 25/75
P-5
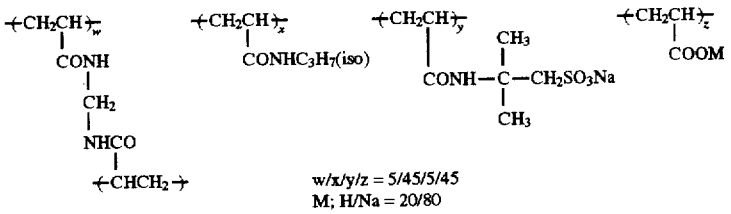
w/x/y/z = 5/45/5/45
M; H/Na = 20/80
P-6
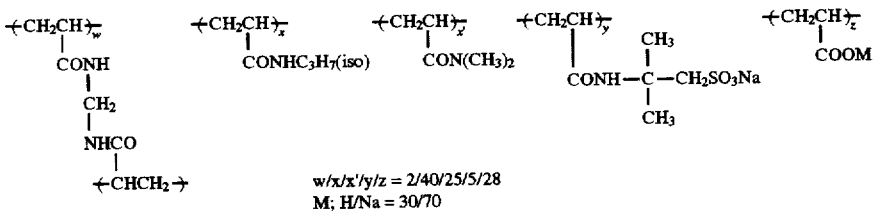
w/x/x'/y/z = 2/40/25/5/28
M; H/Na = 30/70
P-7
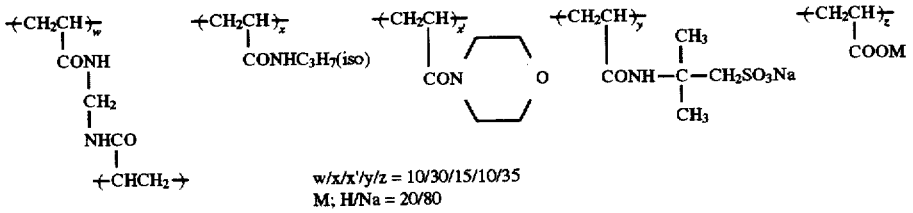
w/x/x'/y/z = 10/30/15/10/35
M; H/Na = 20/80
P-8
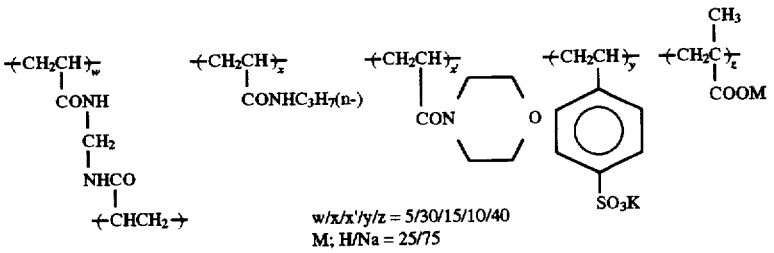
w/x/x'/y/z = 5/30/15/10/40
M; H/Na = 25/75
P-9
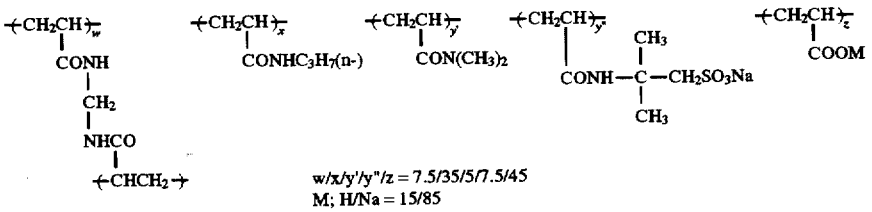
w/x/y'/y"/z = 7.5/35/5/7.5/45
M; H/Na = 15/85

-continued
P-10
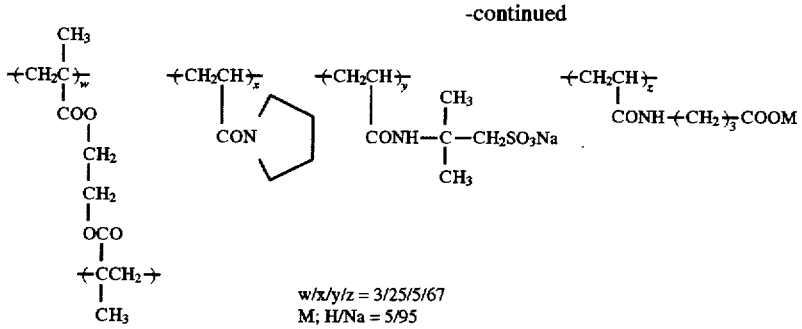
w/x/y/z = 3/25/5/67
M; H/Na = 5/95
P-11
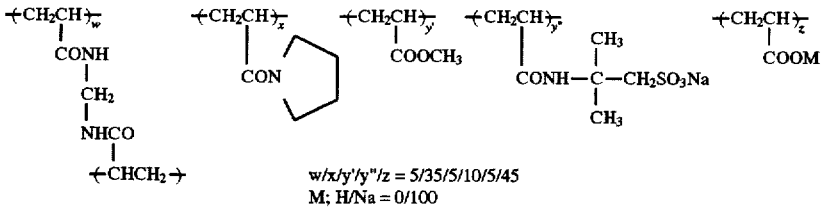
w/x/y'/y"/z = 5/35/5/10/5/45
M; H/Na = 0/100
P-12
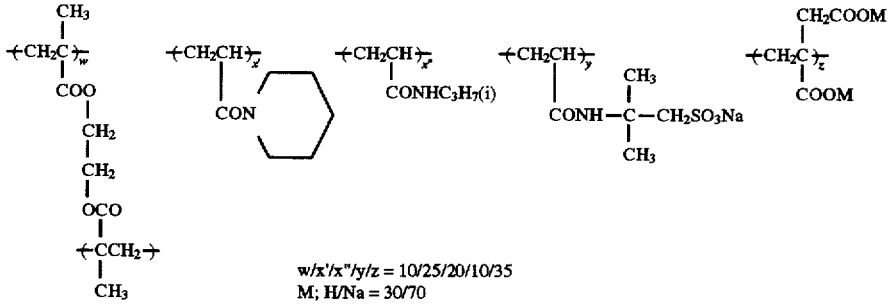
w/x'/x"/y/z = 10/25/20/10/35
M; H/Na = 30/70
P-13
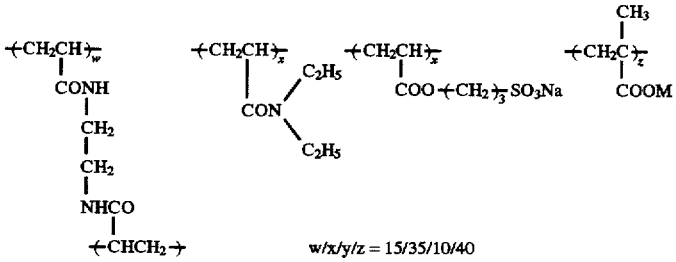
w/x/y/z = 15/35/10/40
M; H/Na = 10/90
P-14
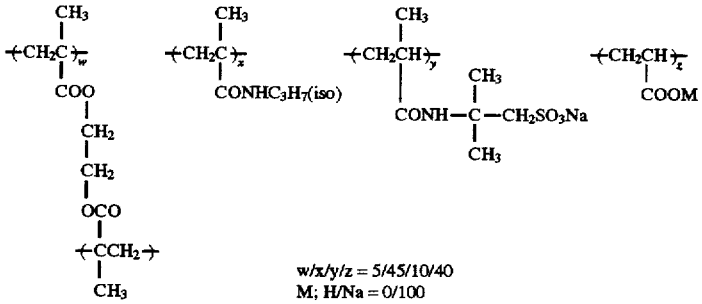
w/x/y/z = 5/45/10/40
M; H/Na = 0/100
P-15,16
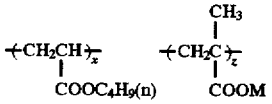
P-15 x/z = 60/40 M = H/Na = 80/20
P-15 x/z = 65/35 M = H/Na = 70/30

-continued

P-17

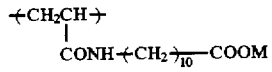

M = H/Na = 70/30

P-18

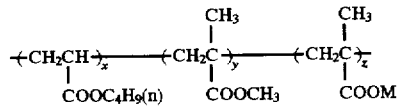

x/y/z = 40/20/40
M = H/K = 95/5

P-19

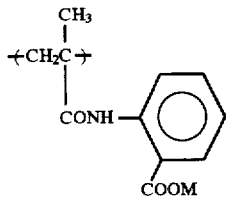

M = H/Na = 80/20

P-20

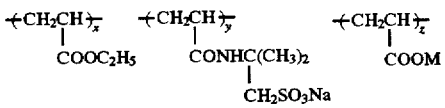

x/y/z = 70/25/5
M = H/Na = 95/5

The compound represented by formula (1), (2) or (3) may be added to any of a light-sensitive emulsion layer, an interlayer or a protective layer. The addition to a plurality of layers is more effective. Also, the addition of the compound represented by formula (2) or (3) to an emulsion layer is effective for the improvement of push-processing suitability.

The addition amount of the compound according to the present invention is preferably from 0.1% to 50%, more preferably from 0.5% to 20%, and most preferably from 2% to 5%, by weight based on gelatin.

At least one layer of the photographic material of the present invention contains a monodisperse tabular silver halide grain emulsion having an aspect ratio of from 3 to 100 and relative standard deviation of grain sizes of 20% or less, which will be described in detail below.

There is no particular limitation on the layers to which the monodisperse tabular silver halide grain emulsion of the present invention is added but it is preferred to add to the light-sensitive emulsion layer positioned remote from the support.

In the second invention, all light-sensitive emulsion layers of the photographic material of the present invention contain a monodisperse tabular silver halide grain emulsion having an aspect ratio of from 3 to 100 and relative standard deviation of grain sizes of 20% or less. By the addition of the monodisperse tabular silver halide grain emulsion to all light-sensitive emulsion layers, high graininess and sharpness can be obtained. Also, in the constitution such that monodisperse tabular silver halide grain emulsion are used in all light-sensitive emulsion layers, the above-described high polymers of the present invention exhibit large effect.

Tabular silver halide emulsion (hereinafter referred to as "tabular grains") of the present invention is described in greater detail below.

Tabular grains for use in the present invention have an aspect ratio of from 3 to 100. The aspect ratio in the present invention is defined as the value obtained by dividing the diameter corresponding to a circle of two parallel main planes (i.e., the diameter of the circle having the same projected area as the main planes) by the distance between main planes (i.e., the thickness of the grain), and the average value of the number average of aspect ratio of each grain is used.

The aspect ratio of the tabular grains for use in the present invention is preferably from 5 to 30.

The tabular grains in the present invention are characterized in that the grains are monodisperse grains and relative standard deviation of grain size distribution is 20% or less. Relative standard deviation used herein is the value obtained by dividing the dispersion of the diameters corresponding to the circles of the projected area (standard deviation) of the tabular grains by the average value of the diameters corresponding to the circles of the projected area of the tabular grains and multiplying by 100.

The silver halide emulsion comprising grain group of uniform grain form and having small dispersion of grain sizes shows almost normal grain size distribution and standard deviation can easily be obtained. The relative standard deviation of grain size distribution of the tabular grains of the present invention is preferably 15% or less, more preferably 12% or less.

The diameter (corresponding to a circle) of the tabular grains of the present invention is from 0.10 to 3 μm and preferably from 0.15 to 2 μm.

The thickness of the grains is preferably from 0.05 to 0.5 μm and more preferably from 0.08 to 0.3 μm.

The grain diameter and the grain thickness in the present invention can be measured from the electron microphotographs of the grains according to the method disclosed in U.S. Pat. No. 4,434,226.

The tabular grains of the present invention have the value obtained by dividing the value of the average diameter corresponding to a circle by the value of the average thickness squared (the value defined as $ECD/t^2$ in JP-A-3-135335 (hereinafter referred to as tabularity)) of 5 or more, preferably 10 or more, and more preferably from 25 to 250.

The preparation method of the tabular grains of the present invention is described below.

Tabular grains can be prepared according to the methods known in the art in arbitrary combination.

The silver halide emulsion for use in the present invention can be prepared according to either of the following methods:

1) Nucleus is formed, then the grain is ripened.
2) Nucleus is formed and the grain is grown through ripening. Accordingly, fundamental processes of nucleus formation, ripening and grain growth are described below.

1. Nucleus Formation Nucleus formation is conducted using gelatin as a dispersion medium and under the condition of pBr from 1.0 to 2.5. pBr can be controlled by silver potential at any stage of nucleus formation, ripening and grain growth.

Low molecular weight gelatin having a molecular weight of 60,000 or less, more preferably from 1,000 to 40,000 is preferred as gelatin.

If the average molecular weight is 60,000 or more, a proportion of tabular grains accounting for in the entire silver halide grains is liable to lessen.

A dispersion medium in which low molecular weight gelatin accounts for 50 wt % or more, more preferably 70 wt % or more, is preferred.

The concentration of the dispersion medium for use in the present invention is from 0.05 to 10 wt %.

In general, alkali-processed gelatin is used, but oxidation-processed gelatin is particularly preferably used. Further, modified gelatin such as acid-processed gelatin and phthalated gelatin can also be used.

In addition, it is more preferred that either one or both of an aqueous solution of $AgNO_3$ or/and an aqueous solution of alkali halide, which are added during nucleus formation, contain gelatin. The gelatin used at this time is preferably the above-described low molecular weight gelatin. In this case, also, a dispersion medium in which low molecular weight gelatin accounts for 50 wt % or more, more preferably 70 wt % or more, is preferred.

The concentration of the dispersion medium in this case is from 0.05 to 5 wt %, preferably from 0.3 to 2.0 wt %.

By the inclusion of the above gelatin in the aqueous solution of $AgNO_3$ and the aqueous solution of alkali halide during nucleus formation, lowering of the proportion of tabular grains in the entire silver halide grains in the emulsion can be prevented. This is presumably because the concentration of gelatin does not become uneven in the vicinity of the pouring in portion of the aqueous solution of $AgNO_3$ and the aqueous solution of alkali halide, as a result, the formation of multiple twin grains can be prevented.

The frequency in the formation of twin planes depends on various supersaturation factors (e.g., the temperature during nucleus formation, the concentration of gelatin, the kind of gelatin, the molecular weight of gelatin, the feeding rate of the aqueous solution of silver salt and the aqueous solution of alkali halide, the concentration of $Br^-$, number of revolutions of stirring, the content of $^-$ in the aqueous solution of alkali halide to be added, the amount of silver halide solvent, the pH, the concentration of salt (e.g., the concentrations of $KNO_3$, $NaNO_3$), the emulsification stabilizer, the antifoggant, the concentration of sensitizing dye), and dependencies thereof have been disclosed in the figure in JP-A-63-92942 by the present inventors.

In the method in which nuclei are formed at low temperature (25° to 30° C.) and the grains are grown in high supersaturation at that low temperature without ripening, when the above supersaturation factors are gradually increased during nucleus formation, main grains formed, in general, change from a) octahedral regular grains to b) grains having a single twin plane, c) grains having two parallel twin planes (objective of the present invention), d) grains having non-parallel twin planes, and e) grains having three or more twin planes.

Accordingly, in the present invention it is preferred to form nuclei under the condition such that the formation probability of grain c) becomes high as far as possible but the formation ratio of grains d) and e) does not become high.

Specifically, while viewing the above-described factor dependencies according to the figure in JP-A-63-92942, various supersaturation factors are controlled so that the abundance ratio of grain c) in the finally obtained silver halide emulsion by the grain formation method of the present invention falls within the claim of the present invention. More specifically, the conditions of the above-described supersaturation factors during the nucleus formation are controlled while viewing the image of replica of the finally formed silver halide grains with a transmission electron microscope.

Further, with respect to the nucleus formation of tabular grains having a content of silver iodide at the center part of 7 mol % or more, the disclosure in JP-A-63-92942 can be referred to.

When measuring the finally obtained tabular grains by controlling these various factors, it was found that the tabular grains prepared by the nucleus formation by the conditions of using the above-described low molecular weight gelatin are particularly low in the mixing ratio of non-tabular grains compared with the case of using general gelatin for photographic use having an average molecular weight of 100,000 as a dispersion medium. Further, the ratio of the hexagonal tabular grains disclosed in JP-A-63-151618 is high.

The grains disclosed in working examples of French Patent 2,534,036 are high in the ratio of triangular tabular grains (grains having three parallel twin planes), this is thought presumably because the nucleus formation was conducted under high supersaturation conditions.

Besides, preferred conditions at nucleus formation in the present invention are as follows.

Temperature of from 5° to 60° C. can be used but when the fine grained tabular grains having an average grain size of 0.5 μm or less are formed, from 5° to 48° C. is preferred. The content of $I^-$ in a solution previously charged is preferably 0.03 mol/liter or less. The feeding rate of $AgNO_3$ is preferably from 0.5 g/min. to 30 g/min. per liter of a reaction aqueous solution.

As the composition of alkali halide solution to be added, the content of $I^-$ to $Br^-$ is the solid solubility limitation or less of AgBrI to be formed, preferably 20 mol % or less.

The polyalkylene oxide block copolymers disclosed in U.S. Pat. Nos. 5,147,771, 5,147,772, 5,147,773 and EP-A-513723 are preferably used in the present invention to enhance monodispersibility of grains. This is described in detail below.

The concentration of the indifferent salts in a reaction solution (the salts which do not directly participate in formation of silver halide) is preferably from 0 to 1 mol/liter. pH of from 2 to 10 can be used as pH of a reaction solution but when reduction sensitization silver speck is introduced, from 8.0 to 10 is preferred. Further, a silver halide solvent can be used in the present invention and the concentration of the silver halide solvent in a reaction solution is preferably from 0 to $3\times10^{-1}$ mol/liter. The kinds of silver halide solvents which can be used are described later.

2. Ripening

In the nucleus formation described in 1. above, fine tabular grain nuclei are formed but, at the same time, many other fine grains are formed (in particular, octahedral and single twin grains). Accordingly, the grains other than the tabular grains are necessary to be dissolved before entering the following described growing stage to obtain the nuclei having the forms of becoming tabular grains and good monodispersibility. For this purpose, Ostwald ripening is conducted subsequent to the nucleus formation.

The ripening method disclosed in JP-A-63-151618 can be used, but the following method is particularly effective in addition to the above.

That is, a method in which a part of the emulsion is taken out as a seed crystal after nucleus formation and an aqueous solution of gelatin is added thereto, or merely an aqueous solution of gelatin is added to the emulsion after nucleus formation and pBr and the concentration of gelatin are adjusted. Preferred pBr in this case is low pBr (1.4 to 2.0) and the concentration of gelatin is from 1 to 10 wt %. Gelatins used in this case are, in general, gelatins commonly used in the photographic art having average molecular weight of from 80,000 to 300,000, and gelatin having molecular weight of 100,000 is preferably used.

Next, the temperature is raised for the first ripening. The tabular grains are grown and the non-tabular grains are dissolved by the first ripening. After adjusting the pBr of the solution to higher pBr (1.7 to 2.6) by the addition of an aqueous solution of $AgNO_3$, a silver halide solvent is added for the second ripening. The concentration of the silver halide solvent in this case is preferably from $1\times10^{-4}$ to $3\times10^{-1}$ mol/liter.

Thus, almost pure tabular grains are obtained by the ripening.

The above-described polyalkylene oxide block copolymers can also preferably be used in this process.

Fundamentally, in the first ripening of low pBr, Ostwald ripening occurs between the twin grains having troughs and the grains not having troughs. In the next second ripening at high pBr and using an AgX solvent, Ostwald ripening occurs between the main planes of the tabular grains and the spherical surfaces of the non-tabular grains and the tabular grains account for almost 100%.

Also, this second ripening has the effects of dissolving the non-tabular grains which did not vanish in the first ripening and making the thicknesses of the seed crystals of the tabular grains even. When the ripening is conducted at low pAg and using a silver halide solvent, the tabular grains grow in the thickness direction and the grains become thick. If the thicknesses are uneven, the growing speeds in the transverse direction during the next crystal growth are uneven. This phenomenon is conspicuous, in particular, during the crystal growth in a low pBr region (1.4 to 2.0), which is not preferred particularly in the present invention.

Since this ripening progresses slowly at low temperature, from the practical point, ripening is conducted at 40° C. to 80° C., preferably from 50° C. to 80° C.

The concentration of gelatin is from 0.05 to 10 wt %, preferably from 1.0 to 5.0 wt %. The emulsion after the termination of this ripening stage contained tabular grains having two parallel twin planes and accounting for 95% of the entire projected area of the silver halide grains, and the tabular grains are, in general, hexagonal tabular grains having corners of the hexagon rounded in shape or circular tabular grains.

The emulsion after the termination of this ripening stage is washed with water by an ordinary washing method and may be used as the tabular grains of the present invention.

After this ripening is finished, in general, the emulsion proceeds to crystal growth stage to further grow the crystals to a desired size.

After the ripening is finished, if the silver halide solvent is unnecessary in the next growth stage, the silver halide solvent is removed as follows.

1) Emulsion is washed. The following conventionally used washing methods can be used, that is, (i) a noodle washing method, (ii) a precipitation washing method using a precipitant, (iii) a precipitation washing method using a modified gelatin such as phthalated gelatin, and (iv) an ultrafiltration method (details are disclosed in G. F. Duffin, *Photographic Emulsion Chemistry*, Focal Press, London, 1966 and the literature hereinafter described).

2) In the case of alkaline silver halide solvent such as $NH_3$, an acid having large solubility product with $Ag^+$ such as $HNO_3$ is added to be neutralized and nullified.

3) In the case of thioether based AgX solvent, an oxidizing agent such as $H_2O_2$ is added to be nullified as disclosed in JP-A-60-136736.

3. Growth

The pBr during the crystal growth stage subsequent to the ripening stage is preferably maintained at 1.4 to 3.0. Further, the feeding rate of Ag and a halogen ion in the crystal growth stage is preferably adjusted to such a degree that the crystal growing speed is from 20 to 100%, more preferably from 30 to 100%, of the critical growing speed of the crystal.

That is, as the growing atmosphere during crystal growth, the higher the pBr and the higher the degree of supersaturation, the higher is the monodispersion degree of the tabular grains according to the growth. However, in high pBr (pBr 2 to 3.0, or the region of formation of tetradecahedral crystal or cubic crystal described below), as the growth in the thickness direction occurs, monodisperse tabular grains having a low aspect ratio can be obtained.

In low pBr (pBr 1.4 to 2.0, or the region of formation of {111} face crystal such as octahedral crystal described below), tabular grains having a high aspect ratio can be obtained by high supersaturation growth.

In this case, the feeding rates of a silver ion and a halogen ion are increased with the crystal growth of the grains, and as the method of increase, as disclosed in JP-B-48-36890 and JP-B-52-16364, the feeding rates (flow rates) of certain concentrations of an aqueous solution of silver salt and an aqueous solution of halide may be increased, alternatively, the concentrations of an aqueous solution of silver salt and an aqueous solution of halide may be increased. Further, an ultrafine grain emulsion having a grain size of 0.10 μm or less is previously prepared and the feeding rate of this ultrafine grain emulsion may be increased. Also, these methods may be used in combination. The feeding rates of an aqueous solution of silver salt and an aqueous solution of halide may be increased intermittently or continuously.

The details thereof and the stirring methods are disclosed in JP-A-55-142329, JP-A-63-151618, U.S. Pat. No. 3,650,757 and British Patent 1,335,925.

In general, as the growing atmosphere, the lower the pBr and the lower the degree of supersaturation, the wider is the grain size distribution of the grains obtained.

Further, the above-described polyalkylene oxide block copolymers are preferably used to make monodisperse emulsion grains.

The monodispersibility and aspect ratio of the tabular grains are as mentioned above.

Fundamentally, the tabular grains of the present invention can be prepared by undergoing the above-described processes of nucleus formation, ripening and growth, but, if desired, the following ripening can be carried out.

No particular limitations are posed on the halide compositions of the silver halides which are laminated on nuclei during grain growth. In many cases, AgBr and AgBrClI (the content of silver iodide is from 0 to the solid solubility limitation, and the content of Cl is from 0 to 50 mol %) are used.

When the iodide distribution in the grain is made a gradually increasing type or a gradually decreasing type, the ratio of the composition of the iodide in the halide which is added with the crystal growth may be gradually increased or decreased, and when the iodide distribution is made sharp types, the ratio of the composition of the iodide in the halide which is added with the crystal growth may be sharply increased or decreased.

Moreover, the method of adding the previously prepared fine grain AgI emulsion (grain size: 0.1 μm or less, preferably 0.06 μm or less) may be used as the supplying method of the iodine ion during crystal growth or may be used in combination with the method of supplying as the aqueous solution of alkali halide. In this case, since fine grain AgI is dissolved and $I^-$ is supplied, $I^-$ is uniformly supplied, therefore, particularly preferred.

In the present invention, it is preferred for the interior of a silver halide grain to include a reduction sensitization speck and from this point the pH of the solution during growth is preferably from 8.0 to 9.5.

In the crystal growth stage, the silver halide solvent described below can be used to accelerate the growth. The concentration of the silver halide solvent at that time is preferably from 0 to $3.0\times10^{-1}$ mol/liter.

According to the above-described methods, tabular grains having an aspect ratio of 3 or more accounting for at least 70% of the entire projected area and the standard deviation of the grain size distribution of the grains accounting for this 70% is 15% or less can be obtained.

Thus, the emulsion according to the present invention is the emulsion in which tabular grains account for 70% or more of the projected area of the entire silver halide grains in the emulsion.

The emulsion grain of the present invention is silver halide containing silver iodide.

The emulsion grain of the present invention contains at least one phase of silver iodide phase, silver iodobromide phase, silver chloroiodobromide phase and silver chloroiodide phase.

Other silver salt, for example, silver thiocyanate, silver sulfide, silver selenide, silver carbonate, silver phosphate, or organic acid silver may be contained as separate grains or as a part of silver halide grains.

The preferred content of silver iodide of the emulsion grain of the present invention is from 0.1 to 20 mol %, more preferably from 0.3 to 15 mol %, and particularly preferably from 1 to 10 mol %.

The relative standard deviation of the silver iodide content distribution of the individual grain of the tabular grains of the present invention is from 20% to 1%, more preferably 10% or less.

The silver iodide content of individual emulsion grain can be measured, for example, by analyzing the composition of the grain one by one with an X-ray microanalyzer. "The relative standard deviation of the silver iodide content distribution of individual grain" means the value obtained by measuring the silver iodide content of at least 100 emulsion grains with an X-ray microanalyzer, dividing the standard deviation of the silver iodide content distribution by the average silver iodide content and multiplying 100. The specific method of measuring the silver iodide content of individual emulsion grain is disclosed, for example, in EP-A-147868.

If the relative standard deviation of the silver iodide content distribution of individual grain is large, the optimal point (conditions of the chemical sensitization suitable for individual grain) of the chemical sensitization of individual grain is different, therefore, it is impossible to get out the capacities of all emulsion grains.

There are cases in which correlation exists and does not exist between the silver iodide content of individual grain Yi (mol %) and the grain size of individual grain Xi (μm) and both cases can be used.

The constitution concerning the halide composition of grains can be confirmed by various methods in combination, for example, X-ray diffraction, an EPMA method (XMA by another name) (a method of scanning a silver halide grain with an electron beam and detecting the silver halide composition), an ESCA method (XPS by another name) (a method of X-raying a grain and spectral-analyzing the photoelectron coming out from the surface of the grain).

It has been difficult to make the relative standard deviation of the silver iodide content distribution among grains (hereinafter referred to as silver iodide distribution among grains) uniform.

To make the silver iodide content of the grain among grains of an emulsion uniform, it is important to make it uniform the size and the shape after Ostwald ripening as far as possible. Further, in the growth stage, an aqueous solution of silver nitrate and an aqueous solution of alkali halide are added by a double jet method while maintaining the pAg constant within the range of 6.0 to 10.0. For carrying out uniform covering, the supersaturation degree of the solution while adding is preferably high, and the addition is conducted, for example, by such a method as disclosed in U.S. Pat. No. 4,242,445, preferably at a comparatively high super-saturation degree such that the growing speed of the crystal becomes from 30 to 100% of the critical growing speed of the crystal.

Further, when an iodide is added it is effective to select the conditions described below to make the silver iodide content of individual grain uniform. That is, the pAg before addition of the iodide is preferably from 8.5 to 10.5, more preferably from 9.0 to 10.5. The temperature is preferably maintained at 50° C. to 30° C.

Further, uniform silver iodide distribution among grains can be attained using the iodide ion releasing agent represented by formula (I) of the present invention comparing with conventional methods. The iodide ion releasing agent represented by formula (I) of the present invention will be described in detail below.

It is preferred that the emulsion grain of the present invention have the structure based on the halide composition. A grain having one or more shells to a substrate grain, e.g., a grain having a double structure, a triple structure, a quadruple structure, a quintuple structure, . . . multiple structure are preferred.

A grain having one or more deposited layers which are not completely covered to a substrate grain, e.g., a grain having a double structure, a triple structure, a quadruple structure, a quintuple structure, . . . multiple structure are also preferred.

The grain epitaxially grown at the selective part of the substrate grain is also preferably used.

The compositions of the shell of the silver halide containing silver iodide of the present invention, the deposited layer and the epitaxial part preferably have high silver iodide contents.

Their silver halide phases may be any of silver iodide, silver iodobromide, silver chloroiodobromide and silver chloroiodide, but silver iodide and silver iodobromide are preferred and silver iodide is more preferred.

When the above silver halide phase is silver iodobromide, a preferred silver iodide content (iodide ion) is from 1 to 45 mol %, more preferably from 5 to 45 mol %, and particularly preferably from 10 to 45 mol %.

It is preferred to prepare a silver halide grain having dislocation lines using the method according to the present invention.

Dislocation lines mean a linear lattice defect on the boundary of the region already slid and the region not yet slid on the sliding surface of a crystal.

Concerning the dislocation lines of silver halide crystals, there are literature such as 1) C. R. Berry, *J. Appl. Phys.*, 27, 636 (1956), 2) C. R. Berry, D. C. Skilman, *J. Appl. Phys.*, 35, 2165 (1964), 3) J. F. Hamilton, *Phot. Sci. Eng.*, 11, 57 (1967), 4) T. Shiozawa, *J. Soc. Phot. Sci. Jap.*, 34, 16 (1971), and 5) T. Shiozawa, *J. Soc. Phot. Sci. Jap.*, 35, 213 (1972), and dislocation lines can be analyzed by an X-ray diffraction method or a direct observation method with a low temperature transmission type electron microscope.

When directly observing dislocation lines with a transmission type electron microscope, the silver halide grains taken out from the emulsion with a care so as not to apply such a pressure as generates dislocation lines on the grains are put on a mesh for observation by an electron microscope, and observation is conducted by a transmission method with the sample being in a frozen state so as to prevent the injury by an electron beam (e.g., printout).

In this case, the thicker the thickness of the grain, the more difficult is the electron beam to be transmitted. Accordingly, it is preferred to use a high pressure type electron microscope (200 kV or more with the thickness of 0.25 μm) for observing clearly.

On the other hand, G. C. Farnell, R. B. Flint, J. B. Chanter, *J. Phot. Sci.*, 13, 25 (1965) discloses the influences of dislocation lines exerted on photographic capacities, and there is indicated that in a tabular silver halide grain having a large grain size and a high aspect ratio, the place where a latent image speck is formed is closely related with the defect in the grain.

JP-A-63-220238 and JP-A-1-201649 disclose the tabular silver halide grains to which dislocation lines are intendedly introduced.

T here are shown in these patents that the tabular grains introduced with dislocation lines are superior in photographic characteristics such as sensitivity and reciprocity law to those not having dislocation lines.

The introduction of dislocation lines into a silver halide grain is described.

It is preferred in the present invention to introduce dislocation lines into the interior of a silver halide grain as follows.

That is, a silver halide grain as a substrate is prepared, a silver halide phase containing silver iodide (the above-described shell of the silver halide, the deposited layer and the epitaxially grown part) is formed on the substrate grain.

As described above, the contents of silver iodide of these silver halide phases are preferably as high as possible.

The content of silver iodide of the substrate grain is preferably from 0 to 15 mol %, more preferably from 0 to 12 mol %, and particularly preferably from 0 to 10 mol %.

The amount of halide to be added to form this high silver iodide content phase on the substrate grain is preferably from 2 to 15 mol %, more preferably from 2 to 10 mol %, and particularly preferably from 2 to 5 mol %, based on the silver amount of the substrate grain.

At this time, this high silver iodide content phase exists preferably within the range of from 5 to 80 mol %, more preferably from 10 to 70 mol %, and particularly preferably from 20 to 60 mol %, based on the silver amount of the entire grain.

Further, the place of the substrate grain on which this high silver iodide content phase is formed is optional, and this phase may be formed covering the substrate grain, or may be formed only on a specific portion. It is also preferred to control the place of the dislocation lines in the interior of the grain by selecting a specific portion to be epitaxially grown.

At that time, composition of the halide to be added, addition method, temperature of the reaction solution, pAg, concentration of a solvent, concentration of gelatin, ionic strength, etc., may be selected freely.

Subsequently, by forming a silver halide shell on the outside of these phases it becomes possible to introduce dislocation lines.

The composition of the silver halide shell may be any of silver bromide, silver iodobromide, or silver chloroiodobromide, but silver bromide or silver iodobromide are preferably used.

When the composition of the shell is a silver iodobromide, a preferred silver iodide content is from 0.1 to 12 mol %, more preferably from 0.1 to 10 mol %, and most preferably from 0.1 to 3 mol %.

A temperature when introducing the above-described dislocation lines is preferably from 30 to 80° C., more preferably from 35 to 75° C., and particularly preferably from 35 to 60° C.

Also, preferred pAg is from 6.4 to 10.5.

In the case of a tabular grain, when viewed from the vertical direction to the main plane of the grain by the electron microphotograph photographed as described above, the place and the number of dislocation lines with respect to each grain can be obtained.

Further, since the dislocation lines can be seen or cannot be seen according to the inclination angle of the sample to the electron beam, it is necessary to detect the existing places of dislocation lines by observing the photographs of the same grain taken at different angles as many as possible to make a thorough observation of dislocation lines.

In the present invention, it is preferred to pursue the existing places and the number of dislocation lines by photographing five kinds of photographs of the grain with respect to the same grain with changing the inclination angle at 5° step using a high pressure type electron microscope.

When introducing dislocation lines into a tabular grain in the present invention, the place to be introduced can be selected from some instances, for example, it is introduced to the summit part of the grain, introduction is limited to the fringe part, or entirely on the main plane, but limiting to the fringe part is particularly preferred.

The fringe part used herein means the periphery of a tabular grain, specifically, in the distribution of silver iodide from the side to the center, viewing from the side direction, the silver iodide content exceeds or is lower than the average silver iodide content of the whole grain for the first time at a certain point, and the periphery means the outside of that point.

It is preferred in the present invention to introduce dislocation lines into a silver halide grain densely.

In the case of introducing dislocation lines into a tabular grain, when the number of dislocation lines are counted according to the above-described method of using an electron microscope, a tabular grain having 10 or more dislocation lines on the fringe part of the grain per one grain is preferred, more preferably 30 or more, and particularly preferably 50 or more.

In the case where dislocation lines exist densely or when dislocation lines are observed mingling with each other, the number of dislocation lines sometimes cannot be counted rightly.

However, even in such a case, it is feasible to count roughly such as about 10, about 20, about 30.

The distribution of the amount of dislocation lines among grains of silver halide grains is preferably uniform. When introducing dislocation lines into a tabular grain in the present invention, it is preferred that tabular grains having 10 or more dislocation lines on the fringe part of the grain per one grain account for 100 to 50% (the number), more preferably 100 to 70%, and particularly preferably 100 to 90%.

When pursuing the ratio of the grains containing dislocation lines and the number of dislocation lines, it is preferred to directly observe dislocation lines of at least 100 grains, more preferably 200 grains or more, and particularly preferably 300 grains or more.

A silver halide solvent is preferably used in the emulsion of the present invention. A silver halide solvent, the whole quantity thereof, can be mixed to the dispersion medium in a reaction vessel before silver and halide are added thereto, and if 1 or 2 or more halide, silver salt or a deflocculant are added, a silver halide solvent can be added together. Alternatively, a silver halide solvent can be added independently at the stage of the addition of halide and silver salt.

As a silver halide solvent other than halogen ion, ammonia or an amine compound, thiocyanate salt, e.g., alkali metal thiocyanate salt, in particular, sodium and potassium thiocyanate and ammonium thiocyanate can be used. The use of thiocyanate is disclosed in U.S. Pat. Nos. 2,222,264, 2,448,534 and 3,320,069. As is disclosed in U.S. Pat. Nos. 3,271,157, 3,574,628 and 3,737,313, commonly used thioether can be used. Also, a thione compound can be used as disclosed in JP-A-53-82408 and JP-A-53-144319.

Various compounds can be present during precipitation process of silver halide to control the nature of silver halide grains. Such a compound may be present in the reaction vessel from the first, or according to an ordinary method, when 1 or 2 or more salt are added they can be added together. As disclosed in U.S. Pat. Nos. 2,448,060, 2,628,167, 3,737,313, 3,772,031 and *Research Disclosure*, Vol. 134, June, 1975, No. 13452, by the presence of copper, iridium, lead, bismuth, cadmium, zinc, (a chalcogen compound such as sulfur, selenium and tellurium), gold and a compound such as a noble metal compound of Group VII during precipitation process of silver halide, characteristics of silver halide can be controlled. The interior of the grain of a silver halide emulsion can be reduction sensitized during precipitation process as disclosed in JP-B-58-1410, Moisar et al., *Journal of Photographic Science*, Vol. 25, 1977, pp. 29 to 2 7.

The tabular grains of the present invention are in general chemically sensitized.

Chemical sensitization can be carried out using active gelatin as disclosed in T. H. James, *The Theory of the Photographic Process*, 4th Ed., Macmillan, 1977, pp. 67 to 76, and also sensitization can be conducted using sulfur, selenium, tellurium, gold, platinum, palladium, or iridium, or two or more of these sensitizers in combination at pAg of from 5 to 10, pH of from 5 to 8, and temperature of from 30 to 80° C. as disclosed in *Research Disclosure*, Vol. 120, April, 1974, 12008, idib., Vol. 34, June, 1975, 13452, U.S. Pat. Nos. 2,642,361, 3,297,446, 3,772,031, 3,857,711, 3,901,714, 4,266,018 and 3,904,415 and British Patent 1,315,755. Chemical sensitization is conducted optimally in the presence of gold compounds and thiocyanate compounds, and also conducted in the presence of sulfur-containing compounds or hypo, sulfur-containing compounds such as thiourea and rhodanine as disclosed in U.S. Pat. Nos. 3,857,711, 4,266,018 and 4,054,457. Chemical sensitization can be conducted in the presence of a so-called auxiliary chemical sensitizer. The compounds known to inhibit fogging during chemical sensitization and to increase sensitivity such as azaindene, azapyridazine, azapyrimidine, are used as a useful auxiliary chemical sensitizer. Chemical sensitization can be conducted in the co-presence of a so-called auxiliary chemical sensitizer reformer. Examples of auxiliary chemical sensitizer reformer are disclosed in U.S. Pat. Nos. 2,131,038, 3,411,914, 3,554,757, JP-A-58-126526 and above described G. F. Duffin, *Photographic Emulsion Chemistry*, pp. 138 to 143. In addition to or in place of chemical sensitization, reduction sensitization can be conducted using, for example, hydrogen as disclosed in U.S. Pat. Nos. 3,891,446 and 3,984,249. Reduction sensitization can be carried out using stannous chloride, thiourea dioxide, polyamine, and the like reducing agents as disclosed in U.S. Pat. Nos. 2,518,698, 2,743,182 and 2,743,183. Further, reduction sensitization can be conducted by low pAg (e.g., less than 5) and/or high pH (e.g., greater than 8) process. Moreover, spectral sensitivity can be improved by the chemical sensitizing methods disclosed in U.S. Pat. Nos. 3,917,485 and 3,966,476.

Further, the sensitizing methods using the oxidizing agents disclosed in JP-A-61-3134 and JP-A-61-3136 can also be used.

The emulsion comprising the tabular grains according to the present invention can be used in combination with the emulsion comprising ordinarily chemically sensitized silver halide grains (hereinafter referred to as non-tabular grains) in the same silver halide emulsion layer. In particular, in the case of a color photographic material, the tabular grain emulsion and the non-tabular grain emulsion can be used respectively in different emulsion layers and/or in the same emulsion layer. Herein, as the non-tabular grains, for example, regular grains having regular crystal form such as a cubic, octahedral or tetradecahedral form, or grains having an irregular crystal form such as a spherical or pebble-like form can be cited. Further, as silver halide of these non-tabular grains, any silver halide such as silver bromide, silver iodobromide, silver iodochlorobromide, silver chlorobromide, and silver chloride. Preferred silver halide is silver iodobromide or silver iodochlorobromide containing 30 mol % or less of silver iodide. Particularly preferred is silver iodobromide containing from 2 mol % to 25 mol % of silver iodide.

In the third invention, a swelling factor of the entire hydrophilic colloid layers on the light-sensitive emulsion layer-coated side of the support of the photographic material of the present invention is from 160% to 200%, and a swelling factor of at least one layer of the hydrophilic colloid layers is from 200% to 400%.

The swelling factor is measured as follows.

The film thickness (Dall) of the photographic material is measured with a contact type film thickness measuring apparatus. Next, a hydrophilic colloid layer on the light-sensitive emulsion layer side is removed with hypochlorous acid, and the sum (Dbase) of the remained support and light-sensitive emulsion layer and a backing layer coated on the opposite side is measured with a contact type film thickness measuring apparatus. The value obtained by subtracting Dbase from Dall is the dry film thickness (Dem) of the entire hydrophilic colloid layers coated on the light-sensitive emulsion layer side.

Subsequently, pure water of 25° C. is dripped on the film face of the light-sensitive emulsion layer side of the photographic material in the room maintained at 25° C. 60% RH. The increment of the film thickness by dripping of the pure water is taken as swollen film thickness (Dswell), and the increment of the film thickness 5 minutes after pure water dripping based on before pure water dripping is measured.

Swelling factor is obtained by the following equation.

$$\text{Swelling Factor}=\{(Dem+Dswell)/Dem\}\times 100$$

The swelling factor of the entire hydrophilic colloid layers coated on the light-sensitive emulsion layer side is preferably from 170% to 190%, and the swelling factor of at least one hydrophilic layer is preferably from 220% to 300%.

A photographic material of the present invention comprises a support having thereon a red-sensitive silver halide emulsion layer, a green-sensitive silver halide emulsion layer, a blue-sensitive silver halide emulsion layer, and light-insensitive interlayer. At least one light-insensitive interlayer is present between each color-sensitive layer, preferably two layers. Further, each spectrally sensitized layer preferably comprises three or more separate layers having different sensitivity. A specific example of preferred layer structure of the photographic material of the present invention is shown below but the present invention is not limited thereto. That is, from the support side, First Layer: Antihalation Layer
Second Layer: Interlayer
Third Layer: Interlayer
Fourth Layer: Low Sensitivity Red-Sensitive Layer
Fifth Layer: Middle Sensitivity Red-Sensitive Layer
Sixth Layer: Low Sensitivity Red-Sensitive Layer
Seventh Layer: Interlayer
Eighth Layer: Interlayer
Ninth Layer: Low Sensitivity Green-Sensitive Layer
Tenth Layer: Middle Sensitivity Green-Sensitive Layer
Eleventh Layer: High Sensitivity Green-Sensitive Layer
Twelfth Layer: Interlayer
Thirteenth Layer: Yellow Filter Layer
Fourteenth Layer: Low Sensitivity Blue-Sensitive Layer
Fifteenth Layer: Middle Sensitivity Blue-Sensitive Layer
Sixteenth Layer: High Sensitivity Blue-Sensitive Layer
Seventeenth Layer: First Protective Layer
Eighteenth Layer: Second Protective Layer
Nineteenth Layer: Third Protective Layer In the case comprising three or more separate layers having the same spectral sensitivity and different sensitivity, the ratio of the coating amount of silver of each separate layer is, when the total silver amount of the spectrally sensitized layer is taken as 100%, preferably high sensitivity layer is from 15 to 40%, middle sensitivity layer is from 20 to 50%, and low sensitivity layer is from 20 to 50%. The coating amount of silver of high sensitivity layer is preferably less than those of middle sensitivity layer and low sensitivity layer.

With respect to the silver halide photographic emulsion of the present invention, and various techniques and inorganic and organic materials which can be used in the silver halide photographic material using the silver halide photographic emulsion of the present invention, in general, those disclosed in *Research Disclosure*, No. 308119 (1989) can be used.

In addition to these, more specifically, for example, techniques and inorganic and organic materials which can be used in the color photographic material to which the silver halide photographic emulsion of the present invention is applicable are disclosed in the following places of EP-A-436938 and the patents cited in the following places.

| Item | Place |
|---|---|
| 1) Layer Structure | line 34, page 146 to line 25, page 147 |
| 2) Silver Halide Emulsion Which Can Be Used in Combination | line 26, page 147 to line 12, page 148 |
| 3) Yellow Coupler | line 35, page 137 to line 33, page 146, lines 21 to 23, page 149 |
| 4) Magenta Coupler | lines 24 to 28, page 149; line 5, page 3 to line 55, page 25 of EP-A-421453 |
| 5) Cyan Coupler | lines 29 to 33, page 149; line 28, page 3 to line 2, page 40 of EP-A-432804 |
| 6) Polymer Coupler | lines 34 to 38, page 149; line 39, page 113 to line 37, page 123 of EP-A-435334 |
| 7) Colored Coupler | line 42, page 53 to line 34, page 137, lines 39 to 45, page 149 |
| 8) Other Functional Coupler | line 1, page 7 to line 41, page 53, line 46, page 149 to line 3 page 150; line 1, page 3 to line 50, page 29 of EP-A-435334 |
| 9) Preservative, Antibacterial Agent | lines 25 to 28, page 150 |
| 10) Formalin Scavenger | lines 15 to 17, page 149 |
| 11) Other Additives | lines 38 to 47, page 153; line 21, page 75 to line 56, page 84 of EP-A-421453, line 40, page 27 to line 40, page 37 |
| 12) Dispersion Method | lines 4 to 24, page 150 |
| 13) Support | line 32 to 34, page 150 |
| 14) Film Thickness, Physical Properties of Film | lines 35 to 49, page 150 |
| 15) Color Development Black-and White Development, Fogging Process | line 50, page 150 to line 47, page 151; lines 11 to 55, page 34 of EP-A-442323, lines 14 to 22, page 35 |
| 16) Desilvering Process | line 48, page 151 to line 53, page 152 |
| 17) Automatic Processor | line 54, page 152 to line 2, page 153 |
| 18) Washing and Stabilizing Processes | lines 3 to 37, page 153 |

The present invention will be illustrated in more detail with reference to examples below, but these are not to be construed as limiting the invention.

EXAMPLE 1

Preparation of Comparative Sample No. 101:

A multilayer color photographic material was prepared as Sample No. 101 by coating each layer having the following composition on an undercoated cellulose triacetate film support having the thickness of 127 μm. The numeral corresponding to each component indicates the addition amount per $m^2$. The function of the compounds added is not limited to the use described.

First Layer: Antihalation Layer

| | silver amount: |
|---|---|
| Black Colloidal Silver | 0.20 g |
| Gelatin | 1.9 g |
| Ultraviolet Absorbing Agent U-1 | 0.1 g |
| Ultraviolet Absorbing Agent U-3 | 0.04 g |
| Ultraviolet Absorbing Agent U-4 | 0.1 g |
| High Boiling Point Organic Solvent Oil-1 | 0.1 g |
| Microcrystal Solid Dispersion of Dye E-1 | 0.1 g |

Second Layer: Interlayer

| | |
|---|---|
| Gelatin | 0.04 g |
| Compound Cpd-C | 5 mg |
| Compound Cpd-J | 5 mg |
| Compound Cpd-K | 3 mg |
| High Boiling Point Organic Solvent Oil-3 | 0.1 g |
| Dye D-4 | 0.8 mg |

Third Layer: Interlayer

| | silver amount: |
|---|---|
| Interior Fogged Fine Grain Emulsion (average grain size: 0.07 μm, AgI content: 1 mol %) | 0.05 g |
| Gelatin | 0.4 g |

Fourth Layer: Low Sensitivity Red-Sensitive Emulsion Layer

| | silver amount: |
|---|---|
| Emulsion A | 0.5 g |
| Gelatin | 0.8 g |
| Coupler C-1 (cyan coupler) | 0.04 g |
| Coupler C-2 (cyan coupler) | 0.10 g |
| Compound Cpd-C | 5 mg |
| High Boiling Point Organic Solvent Oil-2 | 0.1 g |

Fifth Layer: Middle Sensitivity Red-Sensitive Emulsion Layer

| | silver amount: |
|---|---|
| Emulsion B | 0.5 g |
| Gelatin | 0.8 g |
| Coupler C-1 (cyan coupler) | 0.06 g |
| Coupler C-2 (cyan coupler) | 0.13 g |
| High Boiling Point Organic Solvent Oil-2 | 0.1 g |

Sixth Layer: High Sensitivity Red-Sensitive Emulsion Layer

| | silver amount: |
|---|---|
| Emulsion C | 0.4 g |
| Gelatin | 1.1 g |
| Coupler C-3 (cyan coupler) | 0.65 g |

Seventh Layer: Interlayer

| | |
|---|---|
| Gelatin | 0.6 g |
| Color Mixing Preventive Cpd-1 | 2.6 mg |
| Dye-5 | 0.02 g |
| High Boiling Point Organic Solvent Oil-1 | 0.02 g |

Eighth Layer: Interlayer

| | silver amount: |
|---|---|
| Interior Fogged Fine Grain Emulsion (average grain size: 0.07 μm, AgI content: 1 mol %) | 0.05 g |
| Gelatin | 1.0 g |
| Color Mixing Preventive Cpd-A | 0.1 g |
| Compound Cpd-C | 0.1 g |

Ninth Layer: Low Sensitivity Green-Sensitive Emulsion Layer

| | silver amount: |
|---|---|
| Emulsion D | 0.5 g |
| Gelatin | 0.5 g |
| Coupler C-4 (magenta coupler) | 0.1 g |
| Coupler C-5 (magenta coupler) | 0.05 g |
| Coupler C-6 (magenta coupler) | 0.20 g |
| Compound Cpd-B | 0.03 g |
| Compound Cpd-D | 0.02 g |
| Compound Cpd-E | 0.02 g |
| Compound Cpd-F | 0.04 g |
| Compound Cpd-L | 0.02 g |
| High Boiling Point Organic Solvent Oil-1 | 0.1 g |
| High Boiling Point Organic Solvent Oil-2 | 0.1 g |

-continued

Tenth Layer: Middle Sensitivity Green-Sensitive Emulsion Layer

| | silver amount: |
|---|---|
| Emulsion E | 0.4 g |
| Gelatin | 0.6 g |
| Coupler C-4 (magenta coupler) | 0.1 g |
| Coupler C-5 (magenta coupler) | 0.2 g |
| Coupler C-6 (magenta coupler) | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-L | 0.05 g |
| High Boiling Point Organic Solvent Oil-2 | 0.01 g |

Eleventh Layer: High Sensitivity Green-Sensitive Emulsion Layer

| | silver amount: |
|---|---|
| Emulsion F | 0.5 g |
| Gelatin | 1.0 g |
| Coupler C-4 (magenta coupler) | 0.3 g |
| Coupler C-5 (magenta coupler) | 0.1 g |
| Coupler C-6 (magenta coupler) | 0.1 g |
| Compound Cpd-B | 0.08 g |
| Compound Cpd-E | 0.02 g |
| Compound Cpd-F | 0.04 g |
| Compound Cpd-K | 5 mg |
| Compound Cpd-L | 0.02 g |
| High Boiling Point Organic Solvent Oil-1 | 0.02 g |
| High Boiling Point Organic Solvent Oil-2 | 0.02 g |

Twelfth Layer: Interlayer

| | |
|---|---|
| Gelatin | 0.6 g |
| Compound Cpd-L | 0.05 g |
| High Boiling Point Organic Solvent Oil-1 | 0.05 g |

Thirteenth Layer: Yellow Filter Layer

| | silver amount: |
|---|---|
| Yellow Colloidal Silver | 0.07 g |
| Gelatin | 1.1 g |
| Color Mixing Preventive Cpd-A | 0.01 g |
| Compound Cpd-L | 0.01 g |
| High Boiling Point Organic Solvent Oil-1 | 0.01 g |
| Microcrystal Solid Dispersion of Dye E-2 | 0.05 g |

Fourteenth Layer: Interlayer

| | silver amount: |
|---|---|
| Emulsion G | 0.5 g |
| Gelatin | 0.8 g |
| Coupler C-7 (yellow coupler) | 0.3 g |
| Coupler C-8 (yellow coupler) | 0.1 g |
| Coupler C-9 (yellow coupler) | 0.1 g |

Fifteenth Layer: Middle Sensitivity Blue-Sensitive Emulsion Layer

| | silver amount: |
|---|---|
| Emulsion H | 0.5 g |
| Gelatin | 0.9 g |
| Coupler C-7 (yellow coupler) | 0.3 g |
| Coupler C-8 (yellow coupler) | 0.1 g |
| Coupler C-9 (yellow coupler) | 0.1 g |

Sixteenth Layer: High Sensitivity Blue-Sensitive Emulsion Layer

| | silver amount: |
|---|---|
| Emulsion I | 0.4 g |
| Gelatin | 1.2 g |
| Coupler C-7 (yellow coupler) | 0.1 g |
| Coupler C-8 (yellow coupler) | 0.1 g |
| Coupler C-9 (yellow coupler) | 1.1 g |
| High Boiling Point Organic Solvent Oil-2 | 0.1 g |

Seventeenth Layer: First Protective Layer

| | |
|---|---|
| Gelatin | 0.7 g |
| Ultraviolet Absorbing Agent U-1 | 0.2 g |
| Ultraviolet Absorbing Agent U-2 | 0.05 g |
| Ultraviolet Absorbing Agent U-5 | 0.3 g |
| Formalin Scavenger Cpd-H | 0.4 g |
| Dye D-1 | 0.002 g |

-continued

| | |
|---|---|
| Dye D-2 | 0.0005 g |
| Dye D-3 | 0.001 g |
| Eighteenth Layer: Second Protective Layer | |
| | silver amount: |
| Colloidal Silver | 0.1 mg |
| Fine Grain Silver Iodobromide Emulsion (average grain size: 0.06 μm, AgI content: 1 mol %) | 0.1 mg |
| Gelatin | 0.4 g |
| Nineteenth Layer: Third Protective Layer | |
| Gelatin | 0.4 g |
| Polymethyl Methacrylate (average particle size: 1.5 μm) | 0.1 g |
| Copolymer of Methyl Methacrylate/Acrylic Acid in Proportion of 4/6 (average particle size: 1.5 μm) | 0.1 g |

-continued

| | |
|---|---|
| Silicone Oil | 0.03 g |
| Surfactant W-1 | 3.0 mg |
| Surfactant W-2 | 0.03 g |

Further, Additives F-1 to F-8 were added to every emulsion layer in addition to the above components. Moreover, gelatin hardener H-1 and surfactants W-3, W-4, W-5 and W-6 for coating and emulsifying were added to every layer in addition to the above components.

In addition, phenol, 1,2-benzisothiazolin-3-one, 2-phenoxyethanol, phenethyl alcohol, p-benzoic acid butyl ester were added as antibacterial and antifungal agents.

The various compound used are shown below.

C-1

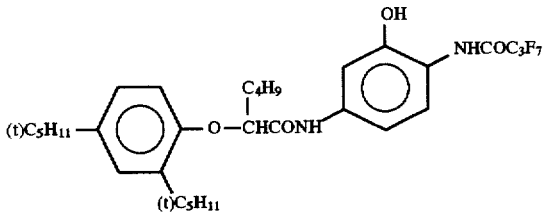

C-2

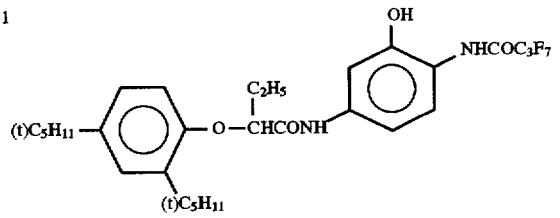

C-3

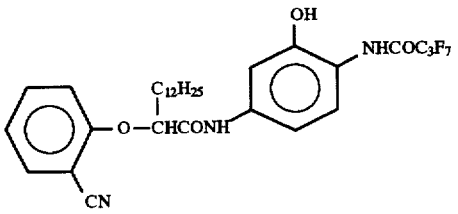

C-4

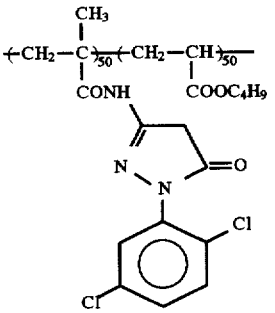

numerals indicate wt %
average molecular weight: about 25,000

C-5

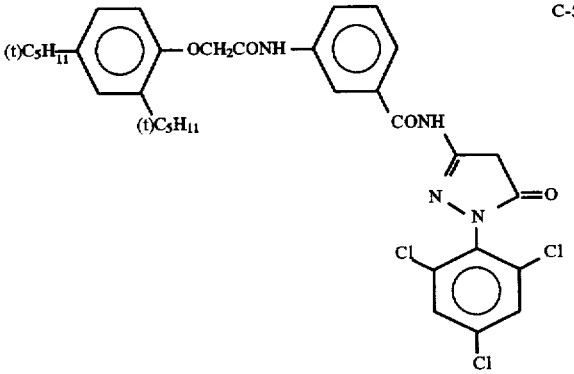

C-6

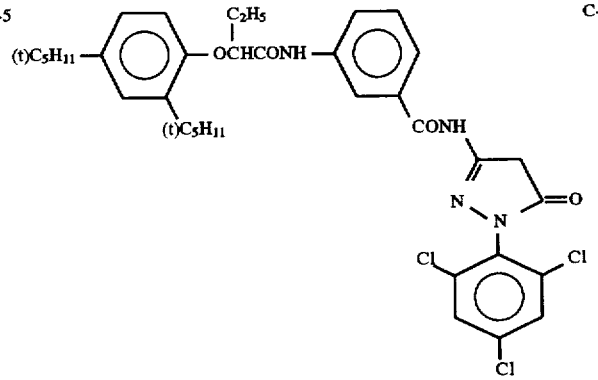

-continued
C-7
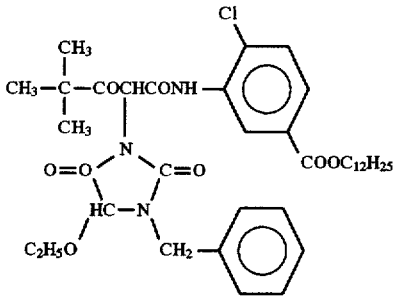
C-8
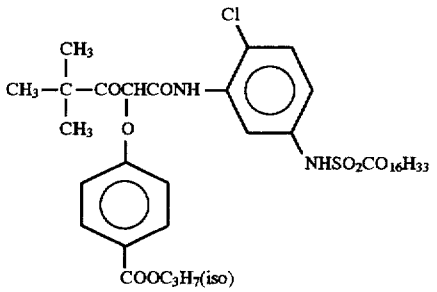
C-9
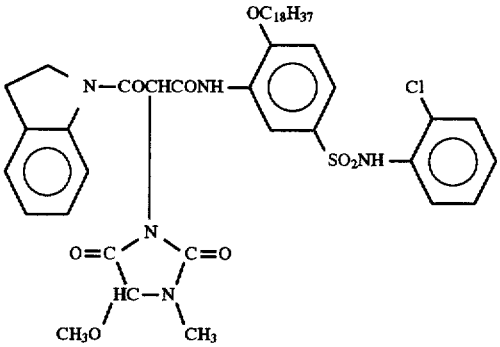
Dibutyl Phthalate Oil-1
Tricresyl Phosphate Oil-2
Oil-3
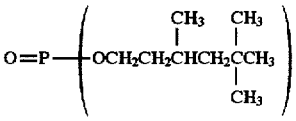
Cpd-B
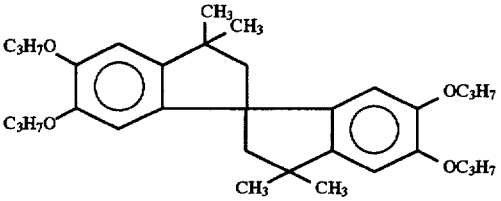
Cpd-C
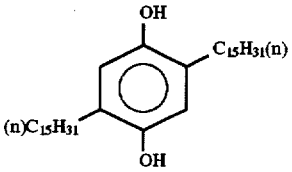
Cpd-D
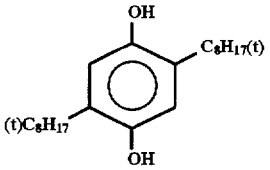
Cpd-E
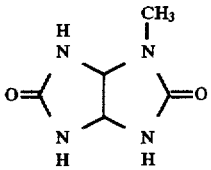
Cpd-F
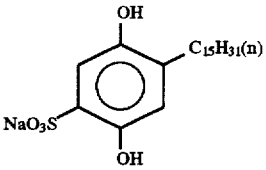
Cpd-H
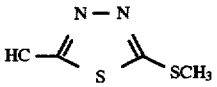
Cpd-I
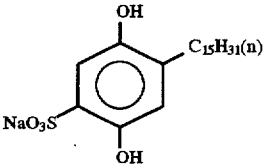
Cpd-J
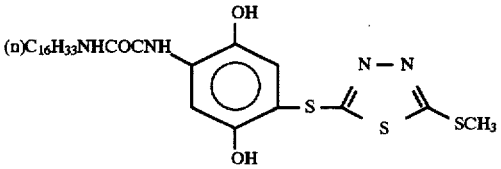

-continued
Cpd-K
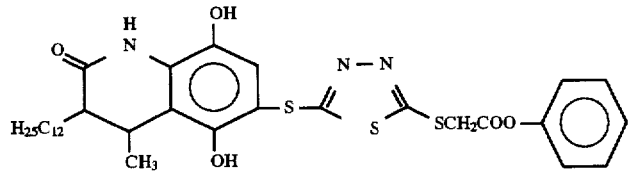
Cpd-L
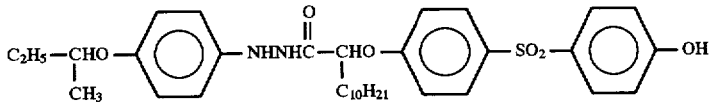
U-1
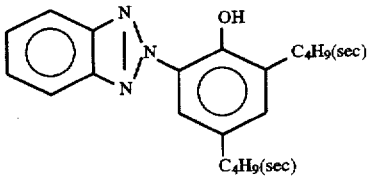
U-2
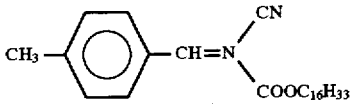
U-3
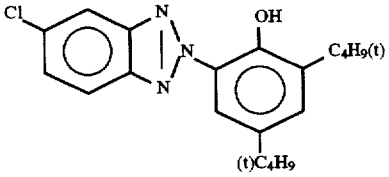
U-4
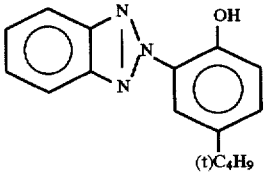
U-5
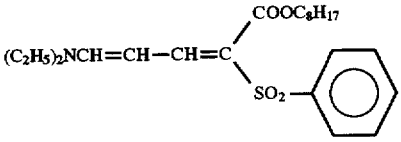
S-1
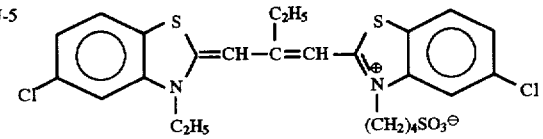
S-2
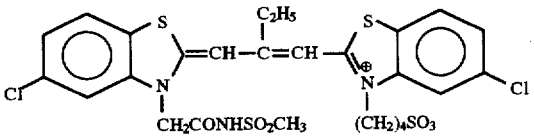
S-3
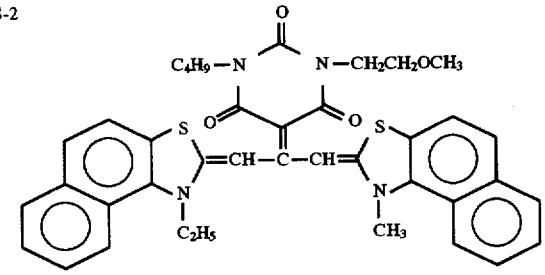
S-4
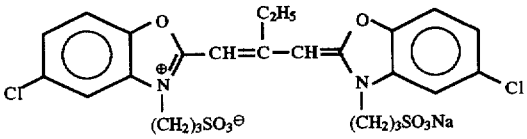
S-5
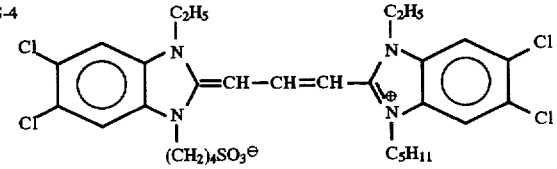
S-6
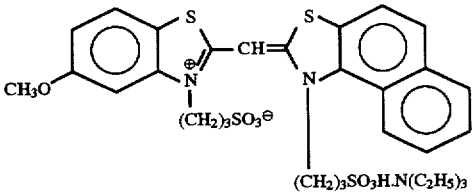
S-7
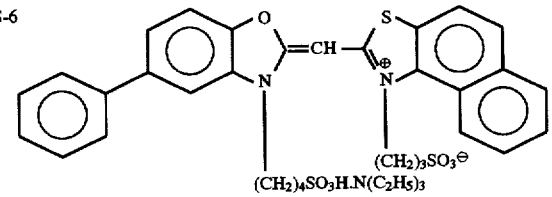
S-8
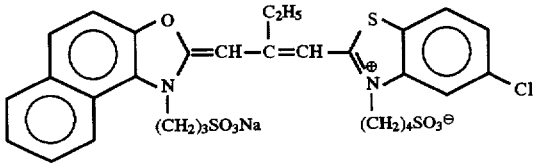

-continued
S-9
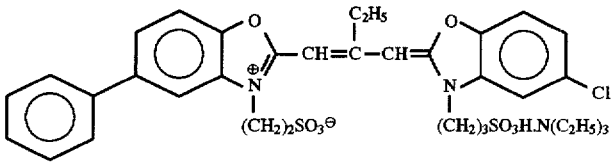
D-1
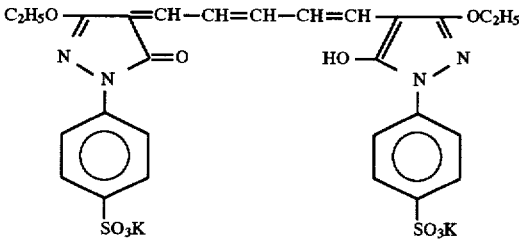
D-2
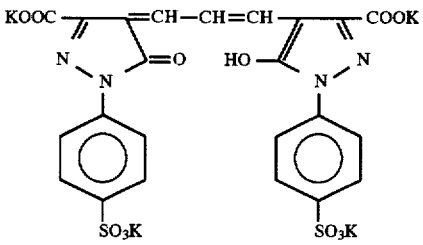
D-3
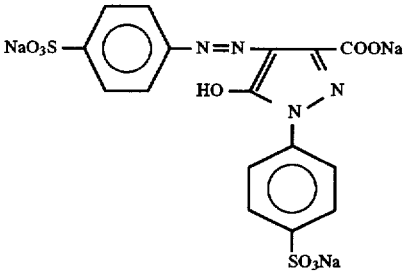
D-4
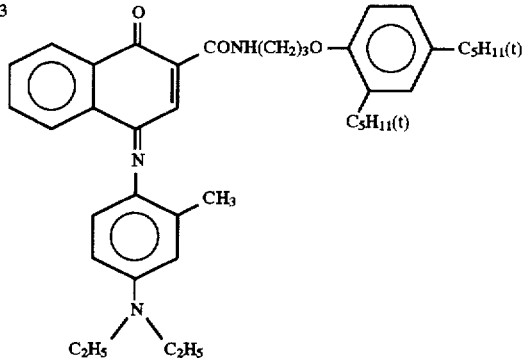
D-5
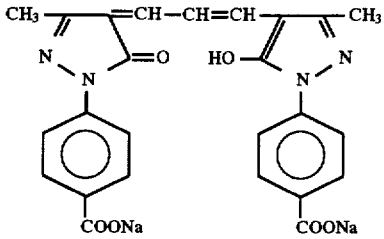
E-1
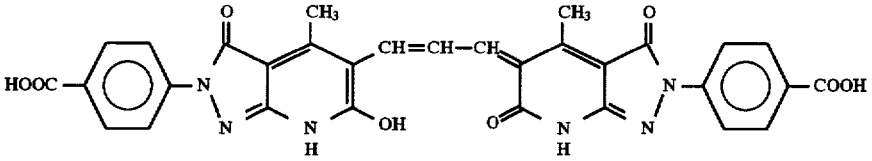
E-2
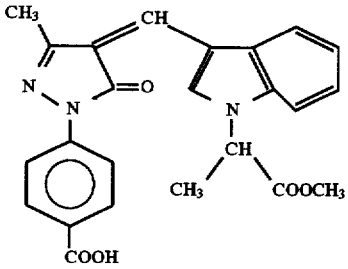
H-1
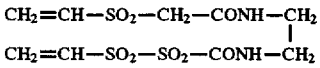
W-1
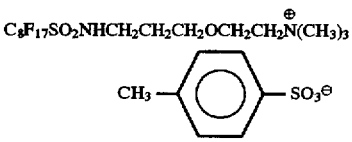
W-2
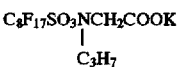

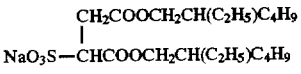

-continued

W-3

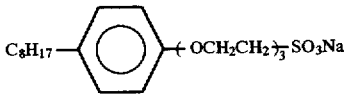

W-4

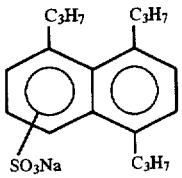

W-5

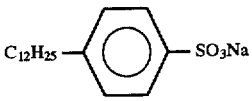

W-6

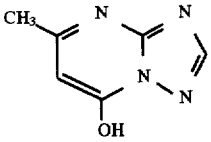

F-1

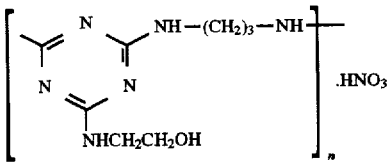

(n = 3–4)

F-2

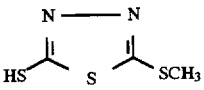

F-3

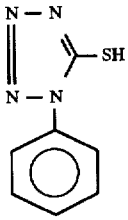

F-4

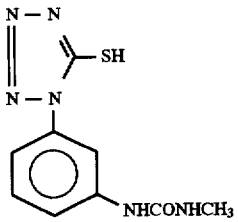

F-5

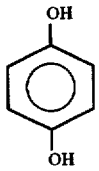

F-6

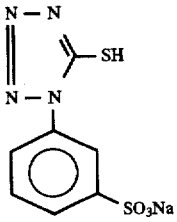

F-7

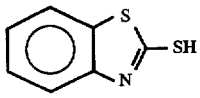

F-8

Further, Silver Iodobromide Emulsions A to I used in Sample No. 101 are as shown in Table 1 below.

TABLE 1

The silver iodobromide emulsions used in Sample No. 101

| Emulsion Name | Characteristic of Grain | Average Grain Size Corresponding to Sphere (μm) | Aspect Ratio | Relative Standard Deviation of Grain Size (%) | AgI Content (%) | Sensitizing Dye | Amount Added (g/mol AgX) |
|---|---|---|---|---|---|---|---|
| A | tetradecahedral | 0.29 | 1 | 12 | 3.6 | S-2 | 0.01 |
| | | | | | | S-3 | 0.27 |
| | | | | | | S-8 | 0.03 |
| B | cuic | 0.38 | 1 | 10 | 4.0 | S-1 | 0.01 |
| | | | | | | S-3 | 0.20 |
| | | | | | | S-8 | 0.01 |

TABLE 1-continued

The silver iodobromide emulsions used in Sample No. 101

| Emulsion Name | Characteristic of Grain | Average Grain Size Corresponding to Sphere (μm) | Aspect Ratio | Relative Standard Deviation of Grain Size (%) | AgI Content (%) | Sensitizing Dye | Amount Added (g/mol AgX) |
|---|---|---|---|---|---|---|---|
| C | twin crystal | 0.70 | 2.2 | 23 | 2.0 | S-2 | 0.01 |
| | | | | | | S-3 | 0.09 |
| | | | | | | S-8 | 0.01 |
| D | cubic | 0.31 | 1 | 14 | 3.8 | S-4 | 0.36 |
| | | | | | | S-5 | 0.1 |
| E | tetradecahedral | 0.45 | 1 | 12 | 3.8 | S-4 | 0.2 |
| | | | | | | S-5 | 0.06 |
| | | | | | | S-9 | 0.05 |
| F | twin crystal | 0.74 | 2.4 | 22 | 2.0 | S-4 | 0.2 |
| | | | | | | S-5 | 0.04 |
| | | | | | | S-9 | 0.08 |
| G | tetradecahedral | 0.4 | 1 | 13 | 4.0 | S-6 | 0.05 |
| | | | | | | S-7 | 0.2 |
| H | twin crystal | 0.65 | 2.3 | 23 | 2.0 | S-6 | 0.04 |
| | | | | | | S-7 | 0.15 |
| I | twin crystal | 1.20 | 2.5 | 21 | 1.5 | S-6 | 0.03 |
| | | | | | | S-7 | 0.16 |

Then, Sample Nos. 102 to 114 were prepared by replacing the emulsion in the ninth layer of Sample No. 101 with silver iodobromide emulsion shown in Table 2 and, further, a part of gelatin in the ninth layer with the same amount of the compound represented by formula (I). The content of the emulsion in the ninth layer and the kind and amount of the compound represented by formula (I) are shown in Table 3.

MP-3/ME-4/acrylamide copolymer (25/25/50) R-1

MP-3/ME-4/acrylamide copolymer (5/5/90) R-2

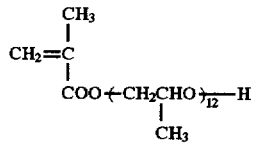

MP-3

-continued

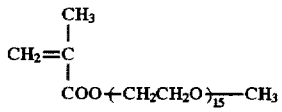

ME-4

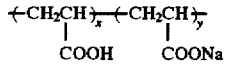

R-3

TABLE 2

The silver iodobromide emulsions used in Sample Nos. 102 to 114

| Emulsion Name | Characteristic of Grain | Average Grain Size Corresponding to Sphere (μm) | Aspect Ratio | Relative Standard Deviation of Grain Size (%) | AgI Content (%) | Sensitizing Dye | Amount Added (g/mol AgX) |
|---|---|---|---|---|---|---|---|
| J | tabular | 0.30 | 3.4 | 23 | 3.8 | S-4 | 0.38 |
| | | | | | | S-5 | 0.11 |
| K | tabular | 0.27 | 3.4 | 16 | 3.8 | S-4 | 0.40 |
| | | | | | | S-5 | 0.14 |
| L | tabular | 0.26 | 3.3 | 13 | 3.8 | S-4 | 0.40 |
| | (Compound R-1 was used during grain formation) | | | | | S-5 | 0.14 |
| M | tabular | 0.25 | 3.3 | 11 | 3.8 | S-4 | 0.40 |
| | (Compound R-2 was used during grain formation) | | | | | S-5 | 0.14 |

TABLE 3

Constitution of Sample Nos. 101 to 114 and the result of evaluation

| Sample No. | Constitution of Sample Emulsion of 9th Layer: Emulsion Name | Aspect Ratio | Average Grain Size (μm) | Relative Standard Deviation of Grain Size | Compound of Formula (I) Added to 9th Layer: Kind | Amount (g/m²) | Evaluation: RMS Granularity of Magenta Color Image | Sensitization Width of Green-Sensitive Layer | Swelling Factor of Entire Layer (%) | Swelling Factor of 9th Layer (%) |
|---|---|---|---|---|---|---|---|---|---|---|
| 101 (Comp.) | D | 1 | 0.31 | 14 | — | None | 0.016 | 0.29 | 181 | about 160 |
| 102 (Comp.) | J | 3.4 | 0.30 | 23 | — | None | 0.016 | 0.25 | 179 | about 150 |
| 103 (Comp.) | K | " | 0.27 | 16 | — | None | 0.012 | 0.24 | 181 | about 170 |
| 104 (Comp.) | L | 3.3 | 0.26 | 13 | — | None | 0.011 | 0.24 | 183 | about 150 |
| 105 (Comp.) | M | " | 0.25 | 11 | — | None | 0.010 | 0.23 | 182 | about 160 |
| 106 (Comp.) | D | 1 | 0.31 | 14 | P-3 | 0.1 | 0.017 | 0.31 | 190 | about 230 |
| 107 (Comp.) | J | 3.4 | 0.30 | 23 | P-3 | 0.1 | 0.016 | 0.30 | 191 | about 220 |
| 108 (Inv.) | K | " | 0.27 | 16 | " | " | 0.013 | 0.29 | 189 | about 240 |
| 109 (Inv.) | L | 3.3 | 0.26 | 13 | " | " | 0.012 | 0.29 | 190 | about 230 |
| 110 (Inv.) | M | " | 0.25 | 11 | " | " | 0.011 | 0.29 | 189 | about 220 |
| 111 (Inv.) | M | " | " | " | P-7 | " | 0.011 | 0.29 | 190 | about 220 |
| 112 (Inv.) | M | " | " | " | P-5 | " | 0.012 | 0.29 | 187 | about 210 |
| 113 (Inv.) | M | 3.3 | 0.25 | 11 | Q-5 | 0.1 | 0.012 | 0.27 | 184 | about 195 |
| 114 (Comp.) | M | " | " | " | R-3 | " | 0.013 | 0.23 | 195 | about 172 |

Each sample of Sample Nos. 101 to 114 were stored for 4 weeks at room temperature and the following evaluation was conducted.

1. Measurement of RMS Granularity

Each sample was subjected to 1/100 sec. exposure and development processed according to Processing Condition A. The amount of exposure was adjusted such that cyan, magenta and yellow density after processing of each sample became 1.0. RMS granularity of cyan color image, magenta color image and yellow color image of each sample processed was measured using an aperture of 50 μm according to ordinary method.

2. Measurement of MTF

Each sample was subjected to ordinary MTF exposure and after being development processed by Processing Condition A, each MTF value of cyan color image, magenta color image and yellow color image of each sample was measured.

3. Measurement of Sensitization Width

Each sample was wedgewise exposed for 1/100 sec. and after being development processed by Processing Condition A, density was measured and sensitometry curve was obtained. Each sample was wedgewise exposed for 1/100 sec. under the same conditions, and development processed by changing the first development time of 6 min. of Processing Condition A to 8 min., then density was measured and sensitometry curve was obtained. Each sensitivity of red-, green- and blue-sensitive layer was obtained from respective sensitometry curve, and difference of sensitivity between the first developing time of 6 min and 8 min was obtained. Sensitivity was represented by the relative value of Log value of reciprocal of exposure amount. This difference of sensitivity was taken as sensitization width.

4. Measurement of Swelling Factor

In the room of 25° C. 60% RH, pure water of room temperature was dripped on the film face of each sample and change of the film thickness of the hydrophilic colloid layer on the support was measured with a contact type film thickness measuring apparatus. The film thickness of the hydrophilic colloid layer was obtained by subtracting the thickness of the support from the entire thickness of the sample. Swelling factor was pursued in % of increment of the film thickness 5 minutes after pure water dripping based on before pure water dripping.

Film thickness of each emulsion layer was obtained by photographing the cross section of raw film and the film swollen by water with an optical microscope and swelling factor was calculated from the film thickness of each layer.

Processing Condition A

| Processing Step | Processing Time (min) | Processing Temperature (°C.) | Tank Capacity (liter) | Replenishment Rate (ml/m²) |
|---|---|---|---|---|
| First Development | 6 | 38 | 12 | 2,200 |
| First Washing | 2 | 38 | 4 | 7,500 |

-continued

Processing Condition A

| Processing Step | Processing Time (min) | Processing Temperature (°C.) | Tank Capacity (liter) | Replenishment Rate (ml/m²) |
|---|---|---|---|---|
| Reversal | 2 | 38 | 4 | 1,100 |
| Color Development | 6 | 38 | 12 | 2,200 |
| Pre-bleaching | 2 | 38 | 4 | 1,100 |
| Bleaching | 6 | 38 | 12 | 220 |
| Fixing | 4 | 38 | 8 | 1,100 |
| Second Washing | 4 | 38 | 8 | 7,500 |
| Final Rinsing | 1 | 25 | 2 | 1,100 |

The composition of each processing solution used was as follows.

| First Developing Solution | Tank Solution | Replenisher |
|---|---|---|
| Pentasodium Nitrilo-N,N,N-trimethylenephosphonate | 1.5 g | 1.5 g |
| Pentasodium Diethylenetriaminepentaacetate | 2.0 g | 2.0 g |
| Sodium Sulfite | 30 g | 30 g |
| Potassium Hydroquinonemonosulfonate | 20 g | 20 g |
| Potassium Carbonate | 15 g | 20 g |
| Sodium Bicarbonate | 12 g | 15 g |
| 1-Phenyl-4-methyl-4-hydroxymethyl-3-pyrazolidone | 1.5 g | 2.0 g |
| Potassium Bromide | 2.5 g | 1.4 g |
| Potassium Thiocyanate | 1.2 g | 1.2 g |
| Potassium Iodide | 2.0 mg | — |
| Diethylene Glycol | 13 g | 15 g |
| Water to make | 1,000 ml | 1,000 ml |
| pH (adjusted with sulfuric acid or potassium hydroxide) | 9.60 | 9.60 |

First Washing Solution and Second Washing Solution
Water was used. Tank solution = Replenisher

| Reversal Solution | Tank Solution | Replenisher |
|---|---|---|
| Pentasodium Nitrilo-N,N,N-trimethylenephosphonate | 3.0 g | same as the tank solution |
| Stannous Chloride Dihydrate | 1.0 g | |
| p-Aminophenol | 0.1 g | |
| Sodium Hydroxide | 8 g | |
| Glacial Acetic Acid | 15 ml | |
| Water to make | 1,000 ml | |
| pH (adjusted with acetic acid or sodium hydroxide) | 6.00 | |

| Color Developing Solution | Tank Solution | Replenisher |
|---|---|---|
| Pentasodium Nitrilo-N,N,N-trimethylenephosphonate | 2.0 g | 2.0 g |
| Sodium Sulfite | 7.0 g | 7.0 g |
| Trisodium Phosphate 12 Hydrate | 36 g | 36 g |
| Potassium Bromide | 1.0 g | — |
| Potassium Iodide | 90 mg | — |
| Sodium Hydroxide | 3.0 g | 3.0 g |
| Citrazinic Acid | 1.5 g | 1.5 g |
| N-Ethyl-N-(β-methanesulfonamidoethyl)-3-methyl-4-aminoaniline.3/2 Sulfate. Monohydrate | 11 g | 11 g |

-continued

| First Developing Solution | Tank Solution | Replenisher |
|---|---|---|
| 3,6-Dithiaoctane-1,8-diol | 1.0 g | 1.0 g |
| Water to make | 1,000 ml | 1,000 ml |
| pH (adjusted with sulfuric acid or potassium hydroxide) | 11.80 | 12.00 |

| Pre-bleaching Solution | Tank Solution | Replenisher |
|---|---|---|
| Disodium Ethylenediaminetetraacetate Dihydrate | 8.0 g | 8.0 g |
| Sodium Sulfite | 6.0 g | 8.0 g |
| 1-Thioglycerol | 0.4 g | 0.4 g |
| Sodium Bisulfite Addition Products of Formaldehyde | 30 g | 35 g |
| Water to make | 1,000 ml | 1,000 ml |
| pH (adjusted with acetic or sodium hydroxide) | 6.30 | 6.10 |

| Bleaching Solution | Tank Solution | Replenisher |
|---|---|---|
| Disodium Ethylenediaminetetraacetate Dihydrate | 2.0 g | 4.0 g |
| Ammonium Ethylenediaminetetraacetato Ferrate Dihydrate | 120 g | 240 g |
| Potassium Bromide | 100 g | 200 g |
| Ammonium Nitrate | 10 g | 20 g |
| Water to make | 1,000 ml | 1,000 ml |
| pH (adjusted with nitric acid or sodium hydroxide) | 5.70 | 5.50 |

| Fixing Solution | Tank solution | Replenisher |
|---|---|---|
| Ammonium Thiosulfate | 80 g | same as the tank solution |
| Sodium Sulfite | 5.0 g | " |
| Sodium Bisulfite | 5.0 g | " |
| Water to make | 1,000 ml | " |
| pH (adjusted with acetic acid or aqueous ammonia) | 6.60 | |

| Final Rinsing Solution | Tank Solution | Replenisher |
|---|---|---|
| 1,2-Benzisothiazolin-3-one | 0.02 g | 0.03 g |
| Polyoxyethylene-p-monononylphenyl Ether (average polymerization degree: 10) | 0.3 g | 0.3 g |
| Polymaleic Acid (average molecular weight: 2,000) | 0.1 g | 0.15 g |
| Water to make | 1,000 ml | 1,000 ml |
| pH | 7.0 | 7.0 |

The results of evaluation were shown in Table 3. As is apparent from Table 3, the sample of the present invention is excellent in graininess and when push-processing is conducted, shows sufficient sensitization width.

EXAMPLE 2

Sample Nos. 201 to 208 were prepared by changing the emulsion of each layer of Sample No. 101 as shown in Table 5, and further 10% of the gelatin in the fourth layer to the sixteenth layer was each replaced with the compound represented by formula (I) as shown in Table 5. The details of the emulsion used were shown in Table 4.

TABLE 4

The silver iodobromide emulsions used in Sample No. 201

| Emulsion Name | Characteristic of Grain | Average Grain Size Corresponding to Sphere (μm) | Aspect Ratio | Relative Standard Deviation of Grain Size (%) | AgI Content (%) | Sensitizing Dye | Amount Added (g/mol AgX) |
|---|---|---|---|---|---|---|---|
| N | tabular | 0.27 | 3.2 | 16 | 3.6 | S-2 | 0.01 |
| | | | | | | S-3 | 0.30 |
| | | | | | | S-8 | 0.05 |
| O | tabular | 0.36 | 3.8 | 14 | 4.0 | S-1 | 0.01 |
| | | | | | | S-3 | 0.24 |
| | | | | | | S-8 | 0.02 |
| P | tabular | 0.66 | 6.6 | 12 | 2.0 | S-2 | 0.02 |
| | | | | | | S-3 | 0.12 |
| | | | | | | S-8 | 0.02 |
| Q | tabular | 0.42 | 5.0 | 15 | 3.8 | S-4 | 0.26 |
| | | | | | | S-5 | 0.08 |
| | | | | | | S-9 | 0.07 |
| R | tabular | 0.70 | 7.0 | 13 | 2.0 | S-4 | 0.26 |
| | | | | | | S-5 | 0.05 |
| | | | | | | S-9 | 0.10 |
| S | tabular | 0.38 | 3.6 | 16 | 4.0 | S-6 | 0.06 |
| | | | | | | S-7 | 0.26 |
| T | tabular | 0.60 | 4.8 | 14 | 2.0 | S-6 | 0.04 |
| | | | | | | S-7 | 0.20 |
| U | tabular | 1.05 | 7.8 | 11 | 1.5 | S-6 | 0.05 |
| | | | | | | S-7 | 0.19 |

With respect to Sample Nos. 101 and 105 prepared in Example 1 and Sample Nos. 201 to 208 prepared in Example 2, RMS of cyan color image, MTF of cyan color image and the sensitization width of the red-sensitive emulsion layer were measured.

TABLE 5

Constitution of Sample Nos. 101, 105, 201 to 208 and the result of evaluation

| | Constitution of Sample | | Constitution of Sample | | | | |
|---|---|---|---|---|---|---|---|
| Sample No. | Using Layer of Monodisperse Tabular Emulsion | Compound of Formula (1) Added to All Layers | RMS Granularity of Cyan Color Image | MTF of Cyan Color Image | Sensitization Width of Red-Sensitive Emulsion Layer | Remaining Silver Amount (mg/m²) | Remaining Color by Processing Condition B |
| 101 (Comp.) | Did not use. | None | 0.015 | 28 | 0.29 | 0.2 | 0.005 |
| 105 (Comp.) | Used only in 9th layer. | None | 0.015 | 34 | 0.29 | 0.4 | 0.02 |
| 201 (Comp.) | Used in all light-sensitive emulsion layers. | None | 0.012 | 40 | 0.26 | 2.0 | 0.05 |
| 202 (Comp.) | Did not use. | P-3 | 0.016 | 26 | 0.32 | 0.2 | 0.005 |
| 203 (Inv.) | Used only in 9th layer. | P-3 | 0.016 | 35 | 0.32 | 0.3 | 0.01 |
| 204 (Inv.) | Used in all light-sensitive emulsion layers. | P-3 | 0.013 | 39 | 0.29 | 0.4 | 0.015 |
| 205 (Inv.) | Used in all light-sensitive emulsion layers. | P-7 | 0.013 | 38 | 0.30 | 0.3 | 0.015 |
| 206 (Inv.) | Used in all light-sensitive emulsion layers. | P-5 | 0.013 | 40 | 0.28 | 0.7 | 0.02 |
| 207 (Inv.) | Used in all light-sensitive emulsion layers. | Q-5 | 0.013 | 40 | 0.27 | 0.4 | 0.015 |
| 208 (Comp.) | Used in all light-sensitive emulsion layers. | R-3 | 0.013 | 38 | 0.26 | 1.5 | 0.04 |

The results obtained are shown in Table 5. As is apparent from Table 5, the samples all the light-sensitive emulsion layers of which contained monodisperse tabular emulsion are excellent in both graininess and sharpness. Lowering of sensitization width and degradation of desilvering ability and remaining color by the use of monodisperse tabular emulsion can be improved by the addition of the polymer compound of the present invention. Therefore, high image quality and excellent processability which are the objects of the present invention can be attained only by the photographic material of the present invention using a monodisperse tabular emulsion and containing the polymer compound of the present invention.

EXAMPLE 3

The present invention is also effective in the new photographic system using the base as described below. 1) Support One hundred weight parts of commercially available polyethylene-2,6-naphthalate polymer and 2 weight parts of Tinuvin P. 326 (product of Ciba Geigy), as an ultraviolet absorbing agent, were dried in a usual method, then, melted at 300° C., subsequently extruded through a T-type die, and stretched 3.0 times in a machine direction at 140° C. and then 3.0 times in a transverse direction at 130° C., and further thermal fixed for 6 seconds at 250° C. and the PEN film having the thickness of 90 μm was obtained.

Further, a part of the film was wound on to a stainless steel spool having a diameter of 20 cm and provided heat history at 110° C. for 48 hours.

2) Coating of undercoat layer

An undercoat layer having the following composition was coated on one side of the above support after both surfaces of which were subjected to corona discharge, UV discharge, further, glow discharge and flame discharge treatments. The undercoat layer was provided on the hotter side at the time of stretching. The corona discharge treatment was carried out using solid state corona processor model 6KVA available from Pillar Co., Ltd. which can treat the support of 30 cm wide at a rate of 20 m/min. At this time, the treatment of 0.375 KV·A·min/$m^2$ was conducted to the support from the reading of the electric current and voltage. The discharge frequency at the treatment time was 9.6 KHz, gap clearance between the electrode and the induction roll was 1.6 mm. UV discharge treatment was conducted by heating at 75° C. Further, glow discharge treatment was conducted by a cylindrical electrode at 3,000 W and irradiated for 30 sec.

| | |
|---|---|
| Gelatin | 3 g |
| Distilled Water | 25 ml |
| Sodium-α-sulfo-di-2-ethylhexyl-succinate | 0.05 g |
| Formaldehyde | 0.02 g |
| Salicylic Acid | 0.1 g |
| Diacetyl Cellulose | 0.5 g |
| p-Chlorophenol | 0.5 g |
| Resorcin | 0.5 g |
| Cresol | 0.5 g |
| $(CH_2{=}CHSO_2CH_2CH_2NHCO)_2CH_2$ | 0.2 g |
| Trimethylolpropane Aziridine 3 Time Mol Addition Product | 0.2 g |
| Trimethylolpropane-Toluene-diisocyanate 3 Time Mol Addition Product | 0.2 g |
| Methanol | 15 ml |
| Acetone | 85 ml |
| Formaldehyde | 0.01 g |
| Acetic Acid | 0.01 g |
| Concentrated Hydrochloric Acid | 0.01 g |

3) Coating of backing layer

On one side of the above support on which no undercoat layer was coated after undercoat layer coating, an antistatic layer, a magnetic recording layer and a sliding layer having the following compositions were coated as backing layers.

3-1) Coating of antistatic layer 3-1-1) Preparation of electrically conductive fine grain dispersion solution (a composite dispersion solution of stannic oxide-antimony oxide)

230 weight parts of stannic chloride hydrate and 23 weight parts of antimony trichloride were dissolved in 3,000 weight parts of ethanol and homogeneous solution was obtained. A 1N aqueous sodium hydroxide solution was dropwise added to the above solution until the pH of the solution reached 3, thereby the coprecipitate of colloidal stannic oxide and antimony oxide was obtained. The thus-obtained coprecipitate was allowed to stand at 50° C. for 24 hours and red brown colloidal precipitate was obtained.

The red brown colloidal precipitate was isolated by a centrifugal separator. Water was added to the precipitate and washed by centrifugation to remove excessive ions. The excessive ions were removed by performing this operation three times.

200 weight parts of the colloidal precipitate from which the excessive ions were removed was again dispersed in 1,500 weight parts of water, atomized in a kiln heated to 650° C., thereby a bluish fine grain powder of a stannic oxide-antimony oxide composite having an average grain size of 0.005 μm was obtained. The specific resistance of this fine grain powder was 5 Ω.cm.

The pH of the mixed solution comprising 40 weight parts of the above fine grain powder and 60 weight parts of water was adjusted to 7.0. This mixed solution was dispersed coarsely by a stirrer, then dispersed using a horizontal sand mill (Dyno Mill, manufactured by WILLYA. BACHOFENAG) until the residence time reached 30 minutes, thus the objective product was prepared. The average grain size of the second agglomerate was about 0.04 μm.

3-1-2) Coating of an electrically conductive layer

The electrically conductive layer having the following formulation was coated on the support so as to the dry film thickness reached 0.2 μm and dried at 115° C. for 60 seconds.

| | |
|---|---|
| Electrically Conductive Fine Grain Dispersion Solution prepared in 3-1-1) | 20 weight parts |
| Gelatin | 2 weight parts |
| Water | 27 weight parts |
| Methanol | 60 weight parts |
| p-Chlorophenol | 0.5 weight part |
| Resorcin | 2 weight parts |
| Polyoxyethylenenonylphenyl Ether | 0.01 weight part |

The resistance of the electrically conductive film obtained was $10^{8.0}$ Ω (100 V) and this showed excellent antistatic property.

3-2) Coating of magnetic recording layer To 1,100 g of magnetic substance Co-adherend γ-$Fe_2O_3$ (acicular, major axis: 0.14 μm, minor axis: 0.03 μm, specific surface area: 41 $m^2$/g, saturation magnetization: 89 emu/g, the surface was surface treated with 2 wt %, respectively, based on $Fe_2O_3$, of aluminum oxide and silicon oxide, coercive force: 930 Oe, $Fe^{+2}/Fe^{+3}$ is 6/94), 220 g of water and 150 g of silane coupling agent of poly(polymerization degree: 16)-oxyethylenepropyltrimethoxysilane were added and kneaded well in an open kneader for 3 hours. This coarsely dispersed viscous solution was dried at 70° C. a whole day and night and the water was removed, and heated at 110° C. for 1 hour to prepare the surface-treated magnetic grains.

Further, this product was again kneaded in the open kneader according to the following formulation.

| | |
|---|---|
| The Above Surface-Treated Magnetic Grain | 1,000 g |
| Diacetyl Cellulose | 17 g |
| Methyl Ethyl Ketone | 100 g |
| Cyclohexanone | 100 g |

Further, this product was finely dispersed by a sand mill (1/4 G) at 200 rpm for 4 hours according to the following formulation.

| | |
|---|---|
| The Above Kneaded Product | 100 g |
| Diacetyl Cellulose | 60 g |
| Methyl Ethyl Ketone | 300 g |
| Cyclohexanone | 300 g |

Further, acetyl cellulose and trimethylolpropane-toluenediisocyanate 3 time mol addition product as a hardening agent were added thereto in an amount of 20 wt % based on the binder. This was diluted with equal amounts of methyl ethyl ketone and cyclohexanone so that the viscosity of the obtained solution became about 80 cp. The solution was coated on the above electrically conductive layer using a bar coater so that the film thickness became 1.2 μm. The magnetic substance was coated in an amount of 62 mg/m$^2$. As matting agents, silica grains (0.3 μm) and aluminum oxide abrasive (0.5 μm) were added each in an amount of 10 mg/m$^2$. Drying was conducted at 115° C. for 6 min (the temperature of the roller and transporting apparatus of the drying zone was 115° C.).

The increase of the color density of $D^B$ of the magnetic recording layer was about 0.1 when a blue filter was used at status M of X-light. Saturation magnetization moment of the magnetic recording layer was 4.2 emu/m$^2$, coercive force was 923 Oe, and rectangular ratio was 65%.

3-3) Preparation of sliding layer

A sliding layer was prepared by coating the following composition on the support so that the coating amount of the solid part of the compound became the following amounts, and dried at 110° C. for 5 min to prepare a sliding layer.

| | |
|---|---|
| Diacetyl Cellulose | 25 mg/m$^2$ |
| $C_6H_{13}CH(OH)C_{10}H_{20}COOC_{40}H_{81}$ (Compound a) | 6 mg/m$^2$ |
| $C_{50}H_{101}O(CH_2CH_2O)_{16}H$ (Compound b) | 9 mg/m$^2$ |

Compound a/Compound b (6/9) were dissolved in xylylene and propylene glycol monomethyl ether solvent (volume ratio: 1/1) by heating at 105° C., and this solution was poured into 10 time amount of propylene glycol monomethyl ether (25° C.) and finely dispersed. This solution was further diluted in 5 time amount of acetone, dispersed again using a high pressure homogenizer (200 atm.) and the obtained dispersion (average grain size: 0.01 μm) was added to the coating solution.

The obtained sliding layer showed excellent capacities of dynamic friction coefficient: 0.06 (a stainless steel hard ball of 5 mmφv, load: 100 g, speed: 6 cm/min), static friction coefficient: 0.07 (clip method). The sliding property with the surface of the emulsion provided dynamic friction coefficient of 0.12.

While the invention has been described in detail and with reference to specific examples thereof, it will be apparent to one skilled in the art that various changes and modifications can be made therein without departing from the spirit and scope thereof.

What is claimed is:

1. A silver halide color photographic material comprising a support having thereon a red-sensitive silver halide emulsion layer, a green-sensitive silver halide emulsion layer, and a blue-sensitive silver halide emulsion layer, wherein at least one emulsion layer contains a monodisperse tabular silver halide emulsion having an aspect ratio of 3 or more and less than 100 and relative standard deviation of grain sizes of 20% or less, and at least one layer contains at least one of the anionic water-soluble polymer represented by formula (1), the dispersion of alkali-soluble polymer represented by formula (2), or the dispersion of polymer represented by formula (3):

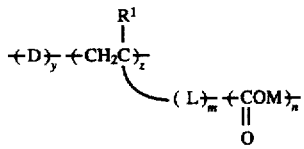

(1)

wherein $R^1$ represents a hydrogen atom, a substituted or unsubstituted lower alkyl group or a halogen atom; L represents a divalent to tetravalent linking group; M represents a hydrogen atom or a cation; m represents 0 or 1; n represents 1, 2 or 3; D represents a repeating unit of an ethylenically unsaturated monomer; y and z each represents weight percentage of each monomer component, y is from 0 to 95, z is from 5 to 100, and y+z=100;

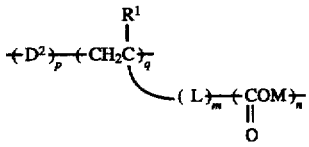

(2)

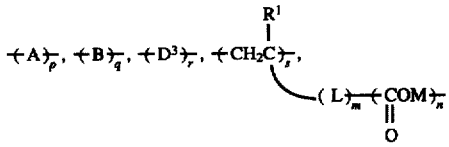

(3)

in formula (2), $D^2$ represents a repeating unit of at least one or more ethylenically unsaturated monomers; p and q each represents weight percentage of each monomer component, p is from 0 to 85, q is from 15 to 100, and p+q=100; in formula (3), A represents a repeating unit obtained by polymerizing a crosslinkable monomer having at least two copolymerizable ethylenically unsaturated groups; B represents a repeating unit obtained by copolymerizing the monomers represented by the following formula (4) the homopolymers of which have a clouding point in an aqueous solution; $D^3$ represents a repeating unit obtained by copolymerizing copolymerizable ethylenically unsaturated monomers other than the above;

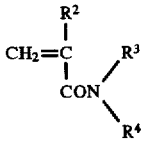

(4)

wherein $R^2$ represents a hydrogen atom or a lower alkyl group; $R^3$ and $R^4$, which may be the same or different, each represents a hydrogen atom, an alkyl group having from 1 to 8 carbon atoms or a substituted alkyl group, $R^3$ and $R^4$ do not represent a hydrogen atom at the same time, and $R^3$ and $R^4$ may be bonded to form a nitrogen-containing heterocyclic ring together with a nitrogen atom; p', q', r' and s' each represents weight percentage of each monomer component, p' is from 0.1 to 60, q' is from 10 to 70, r' is from 0 to 30 and s' is from 25 to 85, and p'+q'+r'+s'=100; and M, R, L, m and n in formulae (2) and (3) have the same meaning as in formula (1).

2. A silver halide color photographic material comprising a support having thereon a red-sensitive silver halide emulsion layer, a green-sensitive silver halide emulsion layer, and a blue-sensitive silver halide emulsion layer, wherein all light-sensitive emulsion layers contain a monodisperse tabular silver halide emulsion having an aspect ratio of 3 or more and less than 100 and relative standard deviation of grain sizes of 20% or less, and at least one layer contains at least one of the anionic water-soluble polymer represented by formula (1), or the dispersion of polymer represented by formula (2) or (3):

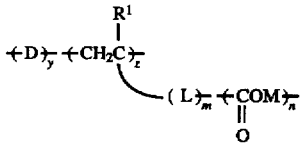

(1)

wherein $R^1$ represents a hydrogen atom, a substituted or unsubstituted lower alkyl group or a halogen atom; L represents a divalent to tetravalent linking group; M represents a hydrogen atom or a cation; m represents 0 or 1; n represents 1, 2 or 3; D represents a repeating unit of an ethylenically unsaturated monomer; y and z each represents weight percentage of each monomer component, y is from 0 to 95, z is from 5 to 100, and y+z=100;

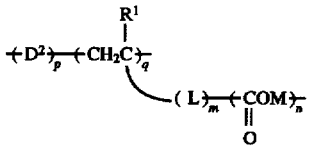

(2)

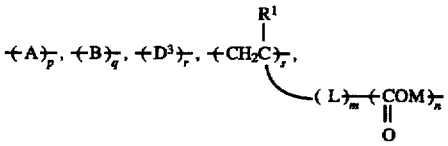

(3)

in formula (2), $D^2$ represents a repeating unit of at least one or more ethylenically unsaturated monomers; p and q each represents weight percentage of each monomer component, p is from 0 to 85, q is from 15 to 100, and p+q=100; in formula (3), A represents a repeating unit obtained by polymerizing a crosslinkable monomer having at least two copolymerizable ethylenically unsaturated groups; B represents a repeating unit obtained by copolymerizing the monomers represented by the following formula (4) the homopolymers of which have a clouding point in an aqueous solution; $D^3$ represents a repeating unit obtained by copolymerizing copolymerizable ethylenically unsaturated monomers other than the above;

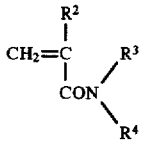

(4)

wherein $R^2$ represents a hydrogen atom or a lower alkyl group; $R^3$ and $R^4$, which may be the same or different, each represents a hydrogen atom, an alkyl group having from 1 to 8 carbon atoms or a substituted alkyl group, $R^3$ and $R^4$ do not represent a hydrogen atom at the same time, and $R^3$ and $R^4$ may be bonded to form a nitrogen-containing heterocyclic ring together with a nitrogen atom; p', q', r' and so each represents weight percentage of each monomer component, p' is from 0.1 to 60, q' is from 10 to 70, r' is from 0 to 30 and s' is from 25 to 85, and p'+q'+r'+s'=100; and M, R L, m and n in formulae (2) and (3) have the same meaning as in formula (1).

3. The silver halide color photographic material claimed in claim 1, wherein a swelling factor of the entire hydrophilic colloid layers on the light-sensitive emulsion layer-coated side of the support is from 160% to 200%, and a swelling factor of at least one layer of said hydrophilic colloid layers is from 200% to 400%.

4. The silver halide color photographic material claimed in claim 2, wherein a swelling factor of the entire hydrophilic colloid layers on the light-sensitive emulsion layer-coated side of the support is from 160% to 200%, and a swelling factor of at least one layer of said hydrophilic colloid layers is from 200% to 400%.

5. The silver halide color photographic material claimed in claim 1, wherein a positive image is obtained by imagewise exposing the photographic material, black-and-white developing the imagewise exposed photographic material and then color developing the photographic material using the remaining silver halide.

6. The silver halide color photographic material claimed in claim 2, wherein a positive image is obtained by imagewise exposing the photographic material, black-and-white developing the imagewise exposed photographic material and then color developing the photographic material using the remaining silver halide.

7. The silver halide color photographic material claimed in claim 3, wherein a positive image is obtained by imagewise exposing the photographic material, black-and-white developing the imagewise exposed photographic material and then color developing the photographic material using the remaining silver halide.

* * * * *